US007071904B2

(12) United States Patent
DeCaro et al.

(10) Patent No.: US 7,071,904 B2
(45) **Date of Patent: *Jul. 4, 2006**

(54) SYSTEM FOR CURRENT MATCHING IN INTEGRATED CIRCUITS

(75) Inventors: Robert E. DeCaro, San Juan Capistrano, CA (US); Patrick N. Dennehey, Lake Forest, CA (US); James W. Everitt, Granite Bay, CA (US)

(73) Assignee: Clare Micronix Integrated Systems, Inc., Aliso Viejo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/141,659

(22) Filed: May 7, 2002

(65) Prior Publication Data

US 2002/0169571 A1 Nov. 14, 2002

Related U.S. Application Data

(60) Provisional application No. 60/290,100, filed on May 9, 2001, provisional application No. 60/348,168, filed on Oct. 19, 2001.

(51) Int. Cl.
*G09G 3/30* (2006.01)

(52) U.S. Cl. ..... 345/76; 345/82; 345/212; 315/169.3

(58) Field of Classification Search ..... 345/76, 345/82, 204, 205, 212; 315/169.1–169.4
See application file for complete search history.

(56) References Cited

U.S. PATENT DOCUMENTS 5,668,569 A 9/1997 Greene et al.
5,903,246 A 5/1999 Dingwall
6,020,864 A 2/2000 Bancal
6,177,767 B1 1/2001 Asai et al.
6,222,357 B1 4/2001 Sakuragi
6,229,508 B1 * 5/2001 Kane ..... 345/82
6,291,942 B1 9/2001 Odagiri et al.
6,326,938 B1 12/2001 Ishida et al.

(Continued)

FOREIGN PATENT DOCUMENTS

JP 2000-293245 10/2000

(Continued)

OTHER PUBLICATIONS

International Search Report dated Oct. 22, 2003 for International Application No. PCT/US02/14685.

(Continued)

*Primary Examiner*—Kent Chang
(74) *Attorney, Agent, or Firm*—Knobbe, Martens, Olson & Bear, LLP

(57) ABSTRACT

A system for providing balanced currents at locations in devices requiring accurate, matched and repeatable current sources, for example visual displays having arrays of light-emitting sources. In one embodiment, the system provides closely balanced currents flowing through column drivers located at or near end regions of a display area. The system allows for more closely matching currents at adjacent columns in a device such as a visual display, wherein the currents are driven by separate driver circuits, thereby eliminating discontinuity in brightness across the entire display area and providing higher quality visual display devices. Another embodiment provides closely balanced currents flowing through column drivers located at or near end regions of a display area. The system additionally allows for balancing currents at adjacent columns or regions throughout the device.

22 Claims, 11 Drawing Sheets

U.S. PATENT DOCUMENTS

| | | | |
|---|---|---|---|
| 6,332,661 | B1 | 12/2001 | Yamaguchi |
| 6,373,454 | B1 | 4/2002 | Knapp et al. |
| 6,433,488 | B1 | 8/2002 | Bu |
| 6,498,592 | B1 | 12/2002 | Matthies |
| 6,501,449 | B1 | 12/2002 | Huang |
| 6,518,962 | B1 | 2/2003 | Kimura et al. |
| 6,756,951 | B1 | 6/2004 | Ishizuka et al. |
| 2001/0024186 | A1 | 9/2001 | Kane et al. |
| 2001/0026251 | A1 | 10/2001 | Hunter et al. |

FOREIGN PATENT DOCUMENTS

| | | |
|---|---|---|
| WO | WO 99/65011 | 12/1999 |

OTHER PUBLICATIONS

International Search Report dated Oct. 22, 2003 for International Application No. PCT/US02/14687.

Office Action dated Jul. 29, 2004 from Application No. 10/141,326, filed May 7, 2002 and claims pending at that time.

Office Action dated Jan. 7, 2005 from Application No. 10/141,326, filed May 7, 2002 and claims pending at that time.

Copy of Amendment filed Apr. 6, 2005 from Application No. 10/141,326.

* cited by examiner

RIGHT END
LEFT END
120
200

614

SYSTEM FOR CURRENT MATCHING IN INTEGRATED CIRCUITS

RELATED APPLICATIONS

This application claims the benefit under 35 U.S.C. § 119(e) of, and hereby incorporates by reference in their entirety, the following:

U.S. Provisional Application No. 60/290,100, filed May 9, 2001 and titled "METHOD AND SYSTEM FOR CURRENT BALANCING IN VISUAL DISPLAY DEVICES"; and U.S. Provisional Application No. 60/348,168, filed Oct. 19, 2001 and titled "PULSE AMPLITUDE MODULATION SCHEME FOR OLED DISPLAY DRIVER".

This application claims the benefit under 35 U.S.C. § 120 of, and hereby incorporates by reference in their entirety, the following:

U.S. application Ser. No. 09/852,060, filed May 9, 2001 and titled "MATRIX ELEMENT VOLTAGE SENSING FOR PRECHARGE";

U.S. application Ser. No. 10/029,563, filed Dec. 20, 2001 and titled "METHOD OF PROVIDING PULSE AMPLITUDE MODULATION FOR OLED DISPLAY DRIVERS"; and U.S. application Ser. No. 10/029,605, filed Dec. 20, 2001 and titled "SYSTEM FOR PROVIDING PULSE AMPLITUDE MODULATION FOR OLED DISPLAY DRIVERS".

This application is related to, and hereby incorporates by reference in their entirety, the following:

U.S. application Ser. No. 10/141,650, filed on even date herewith and titled "SYSTEM FOR CURRENT BALANCING IN VISUAL DISPLAY DEVICES";

U.S. Pat. No. 6,972,742, filed on even date herewith, issued Dec. 6, 2005, and titled "METHOD OF CURRENT BALANCING IN VISUAL DISPLAY DEVICES";

U.S. application Ser. No. 09/904,960, filed Jul. 13, 2001 and titled "BRIGHTNESS CONTROL OF DISPLAYS USING EXPONENTIAL CURRENT SOURCE";

U.S. Pat. No. 6,965,360, filed on even date herewith, issued Nov. 15, 2005 and titled "METHOD OF CURRENT MATCHING IN INTEGRATED CIRCUITS";

U.S. application Ser. No. 10/141,454, filed on even date herewith and titled "METHOD OF SENSING VOLTAGE FOR PRECHARGE";

U.S. application Ser. No. 10/141,648, filed on even date herewith and titled "APPARATUS FOR PERIODIC ELEMENT VOLTAGE SENSING TO CONTROL PRECHARGE"; and U.S. application Ser. No. 10/141,318, filed on even date herewith and titled "METHOD FOR PERIODIC ELEMENT VOLTAGE SENSING TO CONTROL PRECHARGE".

BACKGROUND OF THE INVENTION

1. Field of the Invention

The invention relates to the field of current-driven electronic devices such as visual display devices. More particularly, the invention relates to current balancing circuits for devices requiring accurate, matched and repeatable current drivers, for example visual displays having arrays of light-emitting sources.

2. Description of the Related Technology

Visual display devices are widely used to present visual information and cues to users, operators or viewers of various systems. Not infrequently, visual displays use arrays of light-emitting sources, often consisting of diodes organized in a columnar configuration. These arrays are often arranged such that columns of light-emitting sources are driven by individual current sources. These light-emitting sources are also commonly connected to externally switched rows to complete the electrical circuit, thereby allowing proper illumination of the visual display.

As visual displays typically consist of a multitude of these arrays of light-emitting sources, several (for example 3–4) integrated electronic circuits are required to connect all the columns. Physically, these integrated circuits are necessarily very long and narrow to accommodate the large number of connections and to match the linear connection arrangement of the array. This wide physical separation of circuit components permits temperature variations between sensitive elements, often resulting in performance variations among these elements. In addition, variations in the manufactured characteristics of electronic components also often result in unpredictable and varying performance. Such performance variations often cause poor matching of the current sources at the ends of these individual integrated circuits. When the currents at the ends of an individual column driver circuit are not well matched, the result is a variation in brightness at these end columns that make it difficult to match them to the adjacent columns driven by separate driver circuits. This abrupt discontinuity in brightness is often noticeable to the users of the visual display devices.

Typically, manufacturers in the industry of visual display devices attempt to match all adjacent columns in the same integrated circuit. As the electronic components for adjacent columns are typically located in close proximity on the electronic circuit layout, they tend to be inherently closely matched. In addition, as the eye is relatively insensitive to slowly changing spatial brightness, it is not particularly essential that all adjacent columns of light-emitting sources within an individual integrated circuit be absolutely uniform provided that the differences are not abrupt.

However, when there is a difference in the current sources, a discontinuity often results between columns. As the human eye is very discerning of differences in brightness at sharp edges of light patterns, this results in a noticeable discontinuity in the smoothness of the visual display, resulting in a perceptible degradation in the quality of the display. Accordingly, there is a need in the technology for a column driver circuit in which current sources are closely matched.

SUMMARY OF CERTAIN INVENTIVE ASPECTS

In one embodiment, the invention provides an apparatus for balancing currents in a display device having at least first and second display areas, each including left and right end regions. The apparatus comprises a first driver circuit that is configured to generate a first current, the first driver circuit being located substantially in the right end region of the first display area. The apparatus further comprises a second driver circuit that is configured to generate a second current, the second driver circuit being located substantially in the left end region of the second display area. The apparatus further comprises a circuit that is configured to cause the first current to be substantially matched with the second current.

In another embodiment, the invention provides an apparatus for balancing currents in a display device having at least first and second display areas, each including left and right end regions. The apparatus comprises a means for generating a first current, the first driver circuit being located substantially in the right end region of the first display area.

The apparatus further comprises a means for generating a second current, the second driver circuit being located substantially in the left end region of the second display area. The apparatus further comprises a means for causing the first current to be substantially matched with the second current.

In another embodiment, the invention provides an apparatus for driving balanced currents in a display device having at least first and second display areas. The apparatus comprises a first driver circuit that is configured to generate a first current, the first driver circuit being located substantially in the right end region of the first display area. The apparatus further comprises a current mirror circuit that is configured to receive the first current from the first driver circuit, and further configured to generate at least one mirrored current that is substantially equal to the first current. The apparatus further comprises a second driver circuit that is configured to generate a second current that is based at least in part on the mirrored current, the second driver circuit being located substantially in the left end region of the second display area.

In another embodiment, the invention provides a program storage device for storing instructions that when executed by a processor perform a method of balancing currents in a display device having at least first and second display areas, each including left and right end regions. The method comprises generating a first current from a first driver circuit located substantially in the right end region of the first display area. The method further comprises generating a second current from a second driver circuit located substantially in the left end region of the second display area. The method further comprises substantially matching the first current with the second current.

BRIEF DESCRIPTION OF THE DRAWINGS

The above and other aspects, features and advantages of the invention will be better understood by referring to the following detailed description, which should be read in conjunction with the accompanying drawings. These drawings and the associated description are provided to illustrate certain embodiments of the invention, and not to limit the scope of the invention.

DETAILED DESCRIPTION OF CERTAIN EMBODIMENTS

The following detailed description is directed to certain specific embodiments of the invention. However, the invention can be embodied in a multitude of different ways as defined and covered by the claims. The scope of the invention is to be determined with reference to the appended claims. In this description, reference is made to the drawings wherein like parts are designated with like numerals throughout.

To overcome the above-mentioned visual display limitations, the invention provides a current balancing system that closely matches the current sources at the end columns or regions of arrays driven by individual driver or integrated circuits. This results in a noticeable improvement in the quality of visual displays implementing the apparatus or method of the invention.

As used herein, the term "balancing" does not merely refer to an exact matching of currents through the columns of a driver circuit, but refers also to an approximate matching of currents to a degree sufficient to improve the image quality of a visual display device. Additionally, the terms "balance" and "match" are herein used interchangeably. Moreover, the term "end regions" refers to left and right-end regions in which one or more end column driver circuits are located. For example, up to five end column driver circuits may be located in a left or right end region. In view of the following description, it will be appreciated by one of ordinary skill in the technology that varying the number of end column driver circuits to less or greater than five still achieves the objects of the invention.

Figure 1:
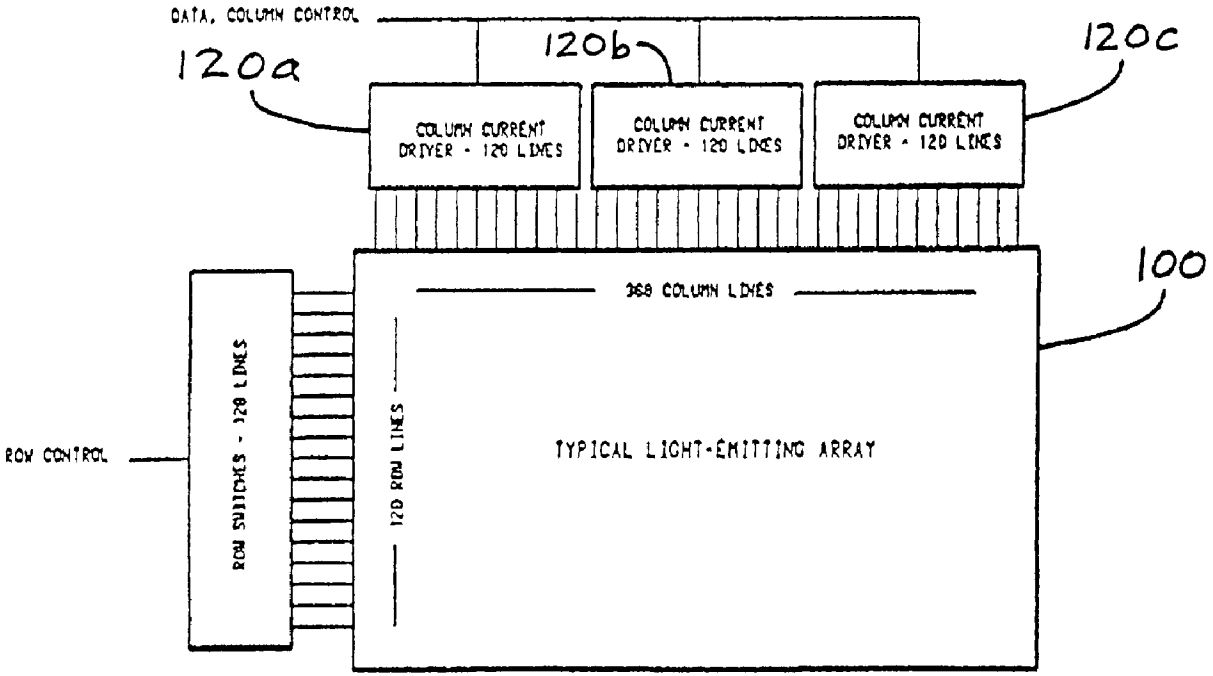
FIG. 1 is a diagram of a visual display device with multiple display portion areas driven by individual driver circuits.

FIG. 1 is a diagram of a visual display device 100 with multiple display portion areas driven by individual driver circuits. In this embodiment, the visual display device 100 comprises three display areas. Although the visual display device 100 typically comprises multiple display areas, often three to four, other numbers of display areas are also within the scope of the present invention. Each display area is typically driven by separate group driver circuits 120*a*, 120*b* and 120*c* (hereinafter collectively referred to as "120"). Each of the group driver circuits 120 typically comprises at least a current source (not shown in this figure) that generates a current to drive one of the display areas. These display areas typically do not represent a physical separation or segmentation of the display device, but instead represent logical areas of the display distinct only in respect to being driven by separate group driver circuits 120. Each of the display areas typically comprises arrays of light-emitting sources, often diodes, arranged in columns. Such light-emitting diodes ("LED's") generate light to illuminate picture elements ("pixels"), which collectively form a desired image on a screen of the display device 100. Each of the display areas typically comprises a plurality of pixels arranged in an array of columns and rows. Other configurations of display devices 100 are also within the scope of the present invention.

Figure 2:
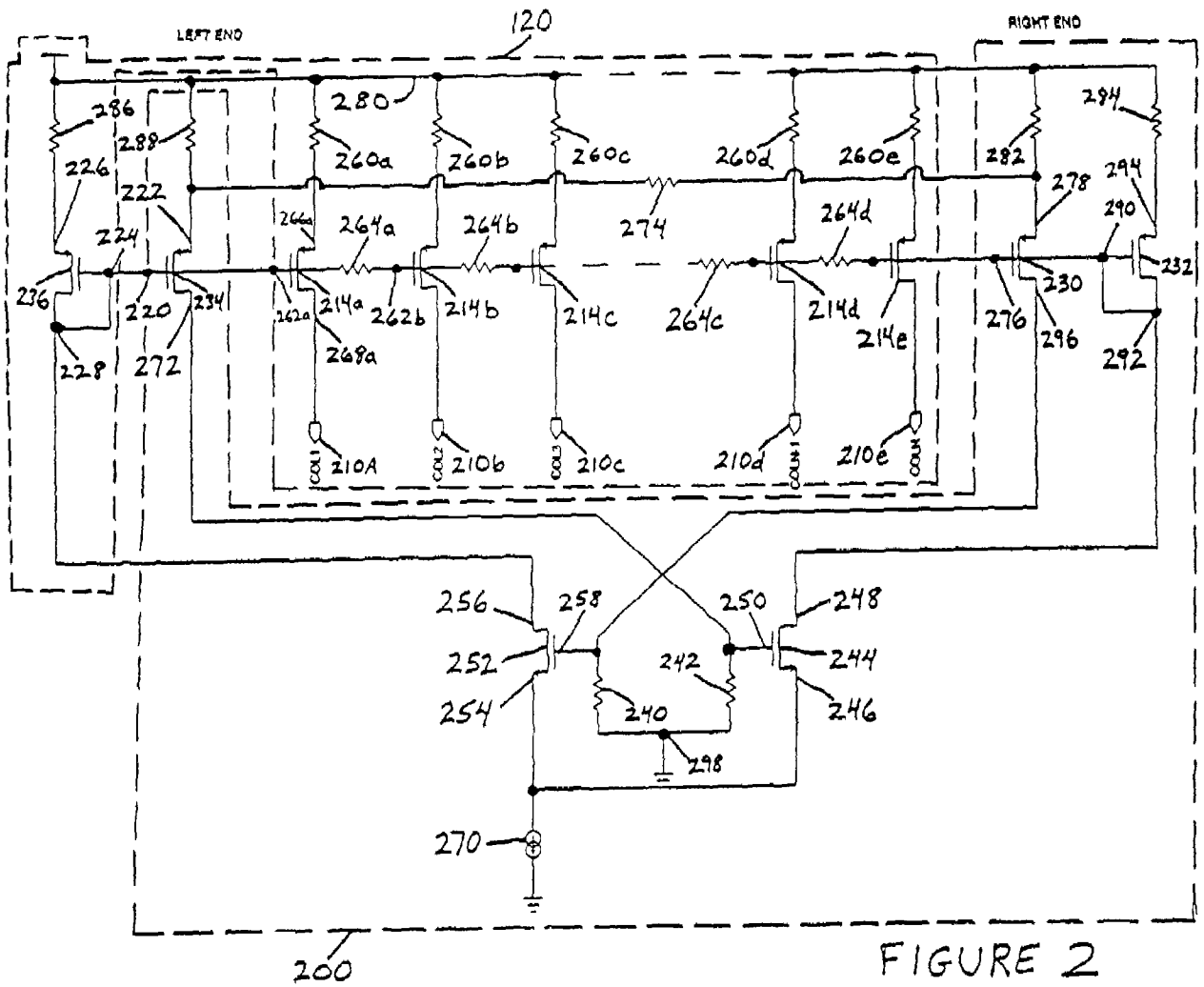
FIG. 2 is a schematic diagram of a balancing circuit in operation with a display area in accordance with one embodiment of the invention.

FIG. 2 is a schematic diagram of a balancing circuit 200 in operation with the display area in accordance with one embodiment of the invention. The balancing circuit 200 balances currents in the group driver circuit 120. The group driver circuit 120 may drive a plurality of columns of light-emitting sources, typically ranging in number up to approximately three hundred eighty columns. However, one of ordinary skill in the technology will appreciate that embodiments in which larger numbers of columns are driven by group driver circuits 120 are within the scope of the invention.

Each of the group driver circuits 120 comprises a plurality of individual driver circuits having current source column transistors 214*a*, 214*b*, 214*c*, 214*d* and 214*e* (hereinafter collectively referred to as "214"). The number of column transistors 214 is typically the same as the number of columns "N" for each of the group driver circuits 120, as depicted by the designation "N" both in FIG. 2 and throughout this application. References to individual columns in this application are made by appending the three letter prefix "COL" with a suffix consisting of the sequential number of the column, starting with "1" at the left-hand side in FIG. 2. For example, the left-most column is referred to as "COL1" 210*a* and the right-most column as "COLN" 210*e*. The number of columns "N", which may vary for different display devices 100 and group driver circuits 120, is not consequential for the present invention.

In this embodiment, each of the transistors 214 comprises a gate terminal (e.g., a gate terminal 262*a* of the transistor 214*a*), a source terminal (e.g., a source terminal 266*a* of the transistor 214*a*) and a drain terminal (e.g., a drain terminal 268*a* of the transistor 214*a*). To enhance the clarity of FIG. 2, only the terminals of the left-most column transistor 214*a* are labeled. However, each of the transistors 214 depicted in the embodiment of FIG. 2 correspondingly comprises a gate, drain and source terminal.

Each of the group driver circuits 120 further comprises a plurality of resistors 264*a*, 264*b*, 264*c* and 264*d* (hereinafter collectively referred to as "264"), each being connected between two gate terminals of two adjacent column transistors 214. As an example, the resistor 264*a* is connected between the gate terminal 262*a* of column transistor 214*a* and the gate terminal 262*b* of the column transistor 214*b*. The drain terminals of the column transistors 214 are connected to light-emitting source array columns 210*a*, 210*b*, 210*c*, 210*d* and 210*e* (hereinafter collectively referred to as "210"), respectively. The source terminals of the column transistors 214 are connected to lower ends (in relation to FIG. 2) of a plurality of resistors 260*a*, 260*b*, 260*c*, 260*d* and 260*e* (hereinafter collectively referred to as "260"), respectively. Each of the resistors 260 is connected at an upper end to a common electrical connection 280.

In this embodiment, each of the group driver circuits 120 further comprises a current mirror diode-connected transistor 236 having a gate terminal 224 that is connected to the gate terminal 220 of source transistor 234. The mirror transistor 236 further includes a drain terminal 228 that is connected to the gate terminal 224 of the same transistor 236. The source terminal 226 of the mirror transistor 236 is connected to a lower end (in relation to FIG. 2) of a resistor 286. The resistor 286 includes an upper end that is connected to the common electrical connection 280.

As shown in the embodiment of FIG. 2, the balancing circuit 200 comprises a current source transistor 234 having a gate terminal 220 that is connected to the gate terminal 262*a* of column transistor 214*a*. The source transistor 234 includes a source terminal 222 that is connected to a lower end of a resistor 288. An upper end of the resistor 288 is connected to the common electrical connection 280.

The balancing circuit 200 further comprises a current source transistor 230 having a gate terminal 276 that is connected to the gate terminal of column transistor 214*e*. The source transistor 230 includes a source terminal 278 that is connected to a lower end (in relation to FIG. 2) of a resistor 282. An upper end of the resistor 282 is connected to the common electrical connection 280. The balancing circuit 200 further comprises a current mirror diode-connected transistor 232 having a gate terminal 290 that is connected to the gate terminal 276 of source transistor 230. The transistor 232 includes a gate terminal 290 that is additionally connected to a drain terminal 292 of the same mirror transistor 232. The mirror transistor 232 further includes a source terminal 294 that is connected to a lower end of a resistor 284. The resistor 284 includes an upper end that is connected to the common electrical connection 280.

The balancing circuit 200 further comprises two closely matched and closely spaced resistors 240 and 242, each having an upper end (in relation to FIG. 2) connected to the drain terminals 296 and 272 of the source transistors 230 and 234, respectively. In one embodiment, the two resistors 240 and 242 are closely matched if the tolerance variance between them allows the precision of current matching desired to be achieved. In another embodiment, for example, to achieve current matching at the output source of 0.1%, closely matched may mean each component has a matching tolerance of 0.02% in the case where the circuit includes 5 components. Each of the resistors 240 and 242 include a lower end that is connected to a common electrical ground 298.

The balancing circuit 200 further comprises a transistor 244 having a gate terminal 250 that is connected to the matched resistor 242 at the connection point to the source transistor 234 as described above. The transistor 244 includes a drain terminal 248 that is connected to the drain terminal 292 of the mirror transistor 232. The balancing circuit 200 further comprises a transistor 252 that is closely matched and closely spaced with transistor 244, and having a gate terminal 258 that is connected to the matched resistor 240 at the connection point to the source transistor 230 as described above. The transistor 252 includes a drain terminal 256 that is connected to the drain terminal 228 of the mirror transistor 236. The transistor 252 includes a source terminal 254 that is connected to a source terminal 246 of the transistor 244.

The balancing circuit 200 further comprises a reference current source 270 that is connected in series with the source terminal 254 of the matched transistor 252 to electrical ground. The current source 270 may be variable or fixed in value. The reference current source 270 sets the original current magnitude to be accurately matched by the balancing circuit 200. The magnitude of the reference current affects the value and size of the electrical components comprising the balancing circuit 200.

The following paragraphs provide a description of the operation of the balancing circuit 200. As described above, each of the resistors 260, 282, 284, 286 and 288 are connected to the common electrical connection 280, yielding a common voltage potential at the connection 280. The common voltage potential at the common connection 280 and the connection of transistors 230, 232, 234 and 236 to the group driver circuit 120, as described above, results in a closely matching current flowing through each of the column transistors 214.

However, temperature- or manufacturing-related variations in the characteristics of the column transistors 214 and resistors 260 from end-to-end may be present, thereby causing unbalanced currents to flow in the source transistors 230 and 234. The matched resistors 240 and 242 compensate for this current imbalance so that the currents flowing through the matched transistors 244 and 252 are adjusted to minimize or eliminate the current imbalance. In one embodiment, the source transistors 230 and 234 provide currents to flow through the resistors 240 and 242, respectively, to the common electrical ground 298. If the currents flowing from the source transistors 230 and 234 are not initially matched, the resistors 240 and 242 produce a discrepancy in gate voltages at the gate terminals 258 and 250 of the transistors 252 and 244. Because of the closely spaced and closely matched characteristics of the resistors 240 and 242, the discrepancy in the gate voltages is preserved. However, since the source terminals 246 and 254 are tied to a common electrical potential (i.e., voltage level), the gate voltages are forced to match, thereby yielding matched currents flowing from the transistors 230 and 234.

As shown in the embodiment of FIG. 2, the left-most column transistor 214*a* is typically physically located near the left-most source transistor 234. Similarly, the right-most column transistor 214*e* is typically physically located near the right-most source transistor 230. Therefore, differences in their currents are minimized due to their close physical proximity on the integrated circuit. Since the gate terminals 262 of the column transistors 214 connect together through resistors 264, any difference in the gate voltage between the column transistors 214*a* and 214*e* is uniformly distributed across the group driver circuit 120. In the embodiment of FIG. 2, a resistor 274 is connected between the connection to the source terminal 222 of the transistor 234 and the connection to the source terminal 278 of the transistor 230. The resistor 274 is added to increase the sensitivity of the detection of a current imbalance between these end transistors 214*a* and 214*e*.

In one embodiment, the transistors referred to herein may be of the class of transistors well known in the technology as Field-Effect Transistors ("FET"). FET's are comprised of three terminals, referred to in the description and depicted in the figures as the gate terminal, source terminal and drain terminal. Additionally, the terminals are also referred to by the corresponding shorthand notation of gate, source and drain. In another embodiment, the transistors may be of the class of transistors well known in the technology as Bipolar Junction Transistors (BJT), or other electronic devices. BJT's are comprised of 3 terminals, referred to as the base terminal, emitter terminal and collector terminal. The three terminals are also referred to by the corresponding shorthand notation of base, emitter and collector. However, other classes of transistors are also within the scope of the present invention.

In one embodiment, the value of the matched resistors 240, 242 is 10K ohms, but other values may operate at least as well. In another embodiment, the value of the series resistors 264 is 1K Ohms, but other values may operate at least as well. In a further embodiment, the value of the resistors 260, 282, 284, 286, 288 is 1K Ohms, but other values may operate at least as well. In another embodiment, the value of the series resistors 274 is 10K Ohms, but other values may operate at least as well. While any specific resistor values are not required by the present invention, a nominal range may be within a decade greater or smaller than the resistor values in the embodiment described in this paragraph. Within a decade means, for example, for a 1K Ohm resistor, a nominal range may be from 100 Ohms to 10K Ohms.

Figure 3:
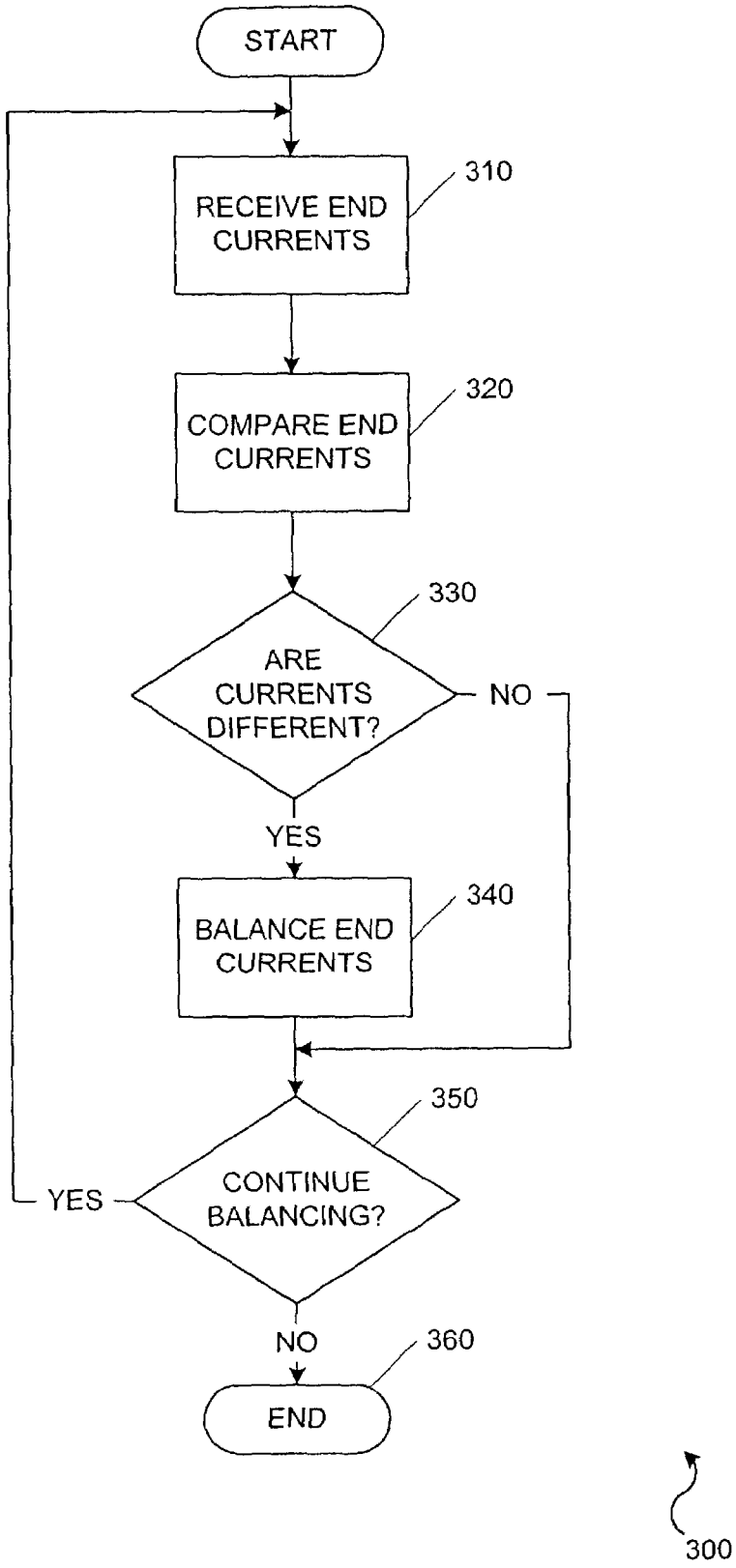
FIG. 3 is a flowchart of a process of balancing currents in accordance with one embodiment of the balancing circuit of FIG. 2.

FIG. 3 is a flowchart of a process 300 of balancing currents in accordance with one embodiment of the balancing circuit 200 of FIG. 2. At block 310, each of the matched transistors 244 and 252 is configured to supply currents to the end regions of the group driver circuit 120. More particularly, the drain terminals 248 and 256 supply currents to the mirror transistors 232 and 236, respectively, and the gate terminals 258 and 250 receive currents from the source transistors 230 and 234, respectively. In a further embodiment, the matched resistors 240 and 242 perform the step of receiving currents from the end regions of the group driver circuit 120. At block 320, the balancing circuit 200 is configured to compare currents received from end regions of the group driver circuit 120. In such an embodiment, the balancing circuit 200 may include a processor (e.g., a programmable processor or an application specific integrated circuit, not shown) that is programmed with instructions to compare currents from said end regions. At decision block 330, the processor of the balancing circuit 200 may determine if the comparison of end region currents produces a difference in said end currents. Whether the end region currents are different is determined by the precision of the current matching that is desired to be achieved in the particular embodiment. If the end region currents are different, the process continues to block 340, described below; otherwise, the process continues directly to block 350, which is also described below.

In the case where the currents in the end regions are of different values, at block 340 the balancing circuit 200 may utilize the processor, or the combination of the matched transistors 244 and 252 and resistors 240 and 242 (as described above), to balance the end currents by compensating for the difference in currents in the end regions. This results in balanced currents at both end regions of the group driver circuit 120. This in turn results in balanced currents flowing through the drain terminals 248 and 256 of the matched transistors 244 and 252 from the current mirror transistors 232 and 236. This produces balanced currents flowing through each of the column transistors 214. At block 350, the balancing circuit 200 determines whether to continue balancing end region currents or not. In one embodiment, the balancing circuit 200 may perform the current balancing process at power-up or reset of the display device 100. In another embodiment, the balancing circuit 200 may perform the current balancing process at predetermined time intervals during normal operation of the display device 100. If further current balancing is desired, the process returns to block 310. Otherwise, the balancing process terminates after block 360.

In one embodiment, the current balancing circuit 200 compensates for differences in current sources between the two end columns of the group driver circuit 120, labeled "COL1" 210*a* and "COLN" 210*e* in FIG. 2. In another embodiment, the balancing circuit 200 balances the currents through columns in a region of the end columns 210*a* and 210*e*. The region of the end columns in this embodiment refers to one, two, three, four or five end columns, or a greater number of columns so that the image quality of the display device 100 is improved. In another embodiment, current balancing in the region of the end columns refers to any number of columns in the group driver circuit 120 that results in balanced currents through the end columns 210*a* and 210*e*, or through any desired number of columns. In a further embodiment, current balancing in the region of the end columns refers to any number of columns in the group driver circuit 120 that results in balanced currents through the columns in the vicinity of the end columns 210*a* and 210*e*. It is likely that the further from the end columns the current balancing is performed the greater the corresponding degradation in display quality.

One skilled in the technology will appreciate that the invention is not limited to the embodiments illustrated by FIGS. 2 and 3, and may be utilized in conjunction with other current balancing embodiments for display driver circuits not here disclosed. In addition, the functionality of the components of the embodiment of FIG. 2 may be combined into fewer components, different components, or further separated into additional components. The components may additionally be implemented to execute on one or more components. As noted above, the current balancing circuit 200 may utilize a processor or an application specific integrated circuit (ASIC) device. In the case of a current balancing circuit 200 executing on a processor, the processor may be programmed with instructions, for example computer code. In other embodiments, some of the components may be implemented to execute on one or more components external to the group driver circuit 120 or current balancing circuit 200. In a further embodiment, the current source circuit shown in FIG. 2 may be a current sink circuit, as will be appreciated by one or ordinary skill in the technology.

Figure 4:
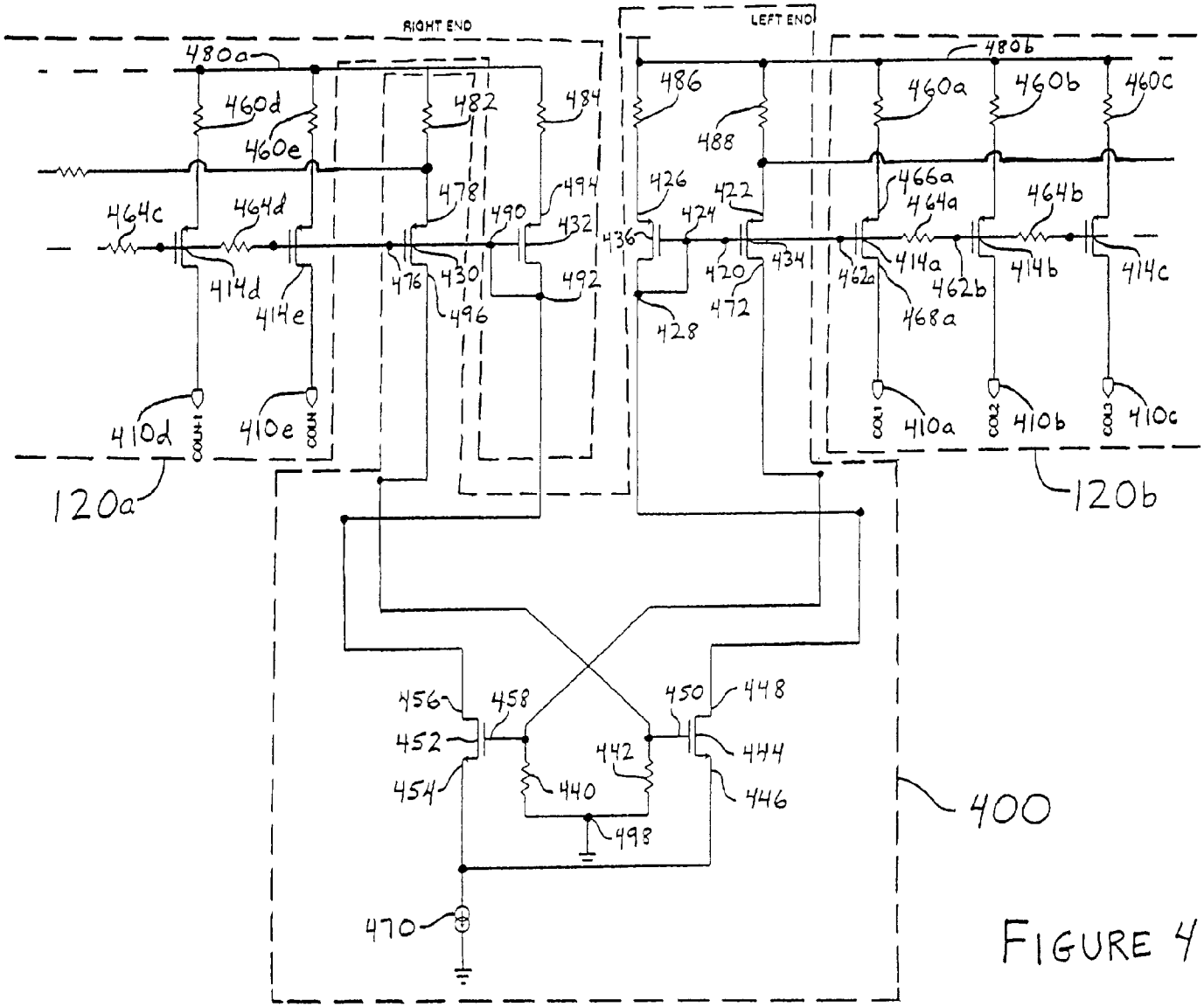
FIG. 4 is a schematic diagram of a current balancing circuit in operation with adjacent group driver circuits in accordance with one embodiment of the invention.

FIG. 4 is a schematic diagram of a current balancing circuit 400 in operation with adjacent group driver circuits 120*a* and 120*b* (see FIG. 1) in accordance with one embodiment of the invention. In FIG. 4, the right end region of the group driver circuit 120*a* is shown with the left end region of the adjacent group driver circuit 120*b*, along with the current balancing circuit 400. Although only the end regions of the group driver circuits 120*a* and 120*b* are shown in FIG. 4, one skilled in the technology would appreciate that each group driver circuit 120 in this embodiment is connected to the adjacent group driver circuit 120 by the balancing circuit 400 as shown in FIG. 4. For example, the group driver circuit 120*b* of FIG. 1 is additionally connected to the group driver circuit 120*c* in a manner similar to that as shown in FIG. 4.

The balancing circuit 400, as shown in the embodiment of FIG. 4, balances currents at the end regions of adjacent group driver circuits 120*a* and 120*b*. Each group driver circuit 120 may drive a plurality of columns of light-emitting sources, typically ranging in number up to approximately three hundred eighty columns. However, one who is skilled in the technology will recognize that embodiments in which even larger numbers of columns are driven by each group driver circuit 120 are within the scope of the invention.

Each of the group driver circuits 120 comprises a plurality of individual driver circuits having current source column transistors 414*a*, 414*b*, 414*c*, 414*d* and 414*e* (hereinafter collectively referred to as "414"). In FIG. 4, only transistors 414*a*, 414*b* and 414*c* are shown for the group driver circuit 120*b*, and only transistors 414*d* and 414*e* are shown for the group driver circuit 120*a*. The number of column transistors 414 is typically the same as the number of columns "N" for each of the group driver circuits 120, as depicted by the designation "N" both in FIG. 4 (see 410*e*) and throughout this application. References herein to individual columns are made by appending the three letter prefix "COL" with a suffix consisting of the sequential number of the column, starting with "1" at the left-hand side of the left end as shown in FIG. 4. For example, the left-most column of the left-hand end region is referred to as COL1 410*a*, and the right-most column of the right hand end region as COLN 410*e*. The actual number of columns "N", which may vary for different display devices 100 and group driver circuits 120, is not consequential for the present invention.

In this embodiment, each of the transistors 414 comprises a gate terminal (e.g., a gate terminal 462*a* of the transistor 414*a*), a source terminal (e.g., a source terminal 466*a* of the transistor 414*a*) and a drain terminal (e.g., a drain terminal 468*a* of the transistor 414*a*). To enhance the clarity of FIG. 4, only the terminals of the left-most column transistor 414*a* at the left end of the group driver circuit 120*b* are labeled. However, each of the transistors 414 depicted in FIG. 4 correspondingly comprises a gate, drain and source terminal (hereinafter collectively referred to as "462," "468," and "466," respectively).

Each of the group driver circuits 120 further comprises a plurality of resistors 464*a*, 464*b*, 464*c* and 464*d* (hereinafter collectively referred to as "464"), each being connected between two gate terminals of adjacent column transistors 414. As an example, the resistor 464*a* is connected between the gate terminal 462*a* of column transistor 414*a* and the gate terminal 462*b* of column transistor 414*b*. Each of the drain terminals 468 of the column transistors 414 are connected to light-emitting source array columns 410*a*, 410*b*, 410*c*, 410*d* and 410*e* (hereinafter collectively referred to as "410"), respectively. Each of the source terminals 466 of the column transistors 414 are connected to lower ends (in relation to FIG. 4) of a plurality of resistors 460*a*, 460*b*, 460*c*, 460*d* and 460*e* (hereinafter collectively referred to as "460"), respectively. Each of the resistors 460 of the group driver circuit 120*a* is connected at an upper end to a common electrical connection 480*a*. Similarly, each of the resistors 460 of the group driver circuit 120*b* is connected at an upper end to a common electrical connection 480*b*.

In this embodiment, each of the group driver circuits 120 further comprises a current mirror diode-connected transistor 432 having a gate terminal 490 that is connected to the gate terminal 476 of the source transistor 430. The transistor 432 includes a gate terminal 490 that is additionally connected to a drain terminal 492 of the same mirror transistor 432. The mirror transistor 432 further includes a source terminal 494 that is connected to a lower end of a resistor 484. The resistor 484 includes an upper end that is connected to the common electrical connection 480*a*.

As shown in the embodiment of FIG. 4, the balancing circuit 400 comprises a current source transistor 434 having a gate terminal 420 that is connected to the gate terminal 462*a* of column transistor 414*a*. The source transistor 434 includes a source terminal 422 that is connected to a lower end of a resistor 488. An upper end of the resistor 488 is connected to the common electrical connection 480*b*. The balancing circuit 400 further comprises a current mirror diode-connected transistor 436 having a gate terminal 424 that is connected to the gate terminal 420 of the source transistor 434. The mirror transistor 436 further includes a drain terminal 428 that is connected to the gate terminal 424 of the same transistor 436. The source terminal 426 of the mirror transistor 436 is connected to a lower end (in relation to FIG. 4) of a resistor 486. The resistor 486 includes an upper end that is connected to the common electrical connection 480*b*.

As further shown in the embodiment of FIG. 4, the balancing circuit 400 further comprises a current source transistor 430 having a gate terminal 476 that is connected to the gate terminal of column transistor 414*e*. The source transistor 430 includes a source terminal 478 that is connected to a lower end (in relation to FIG. 4) of a resistor 482. An upper end of the resistor 482 is connected to the common electrical connection 480*a*.

The balancing circuit 400 further comprises two closely matched and closely spaced resistors 442 and 440, each having an upper end (in relation to FIG. 4) connected to drain terminals 496 and 472 of the source transistors 430 and 434, respectively. In one embodiment, the two resistors 440 and 442 are closely matched if the performance variance between them is less than the precision of current matching variance trying to be achieved. In another embodiment, the two resistors 440 and 442 are closely matched if the performance variance between them is less than one percent. Each of the resistors 440 and 442 includes a lower end that is connected to a common electrical ground 498.

The balancing circuit 400 further comprises a transistor 444 having a gate terminal 450 that is connected to the matched resistor 442 at the connection point to the source transistor 430 as described above. The transistor 444 includes a drain terminal 448 that is connected to the drain terminal 428 of the mirror transistor 436. The balancing circuit 400 further comprises a transistor 452 that is closely matched and closely spaced with transistor 444, and having a gate terminal 458 that is connected to the matched resistor 440 at the connection point to the source transistor 434 as described above. The transistor 452 includes a drain terminal 456 that is connected to the drain terminal 492 of the mirror transistor 432. The transistor 452 includes a source terminal 454 that is connected to a source terminal 446 of the transistor 444.

The balancing circuit 400 further comprises a reference current source 470 that is connected in series with the source terminal 454 of the matched transistor 452 to electrical ground. The current source 470 may be variable or fixed in value.

The following paragraphs provide a description of the operation of the balancing circuit 400. As described above, each of the resistors 460*a*, 460*b*, 460*c*, 486 and 488 is connected to the common electrical connection 480*b*, and similarly each of the resistors 460*d*, 460*e*, 482 and 484 is connected to the common electrical connection 480*a*. It is desirable to maintain the common voltage potentials at the common connections 480*a* and 480*b* to be substantially the same.

However, temperature- or manufacturing-related variations in the characteristics of the group driver circuits 120*a* and 120*b* may be present, thereby causing unbalanced currents to flow in respective transistors 414 and, consequently, in the source transistors 430 and 434. The matched resistors 440 and 442 compensate for this current imbalance so that the currents flowing through the matched transistors 444 and 452 are adjusted to minimize or eliminate the current imbalance. In one embodiment, the source transistors 434 and 430 provide currents to flow through the resistors 440 and 442, respectively, to the common electrical ground 498. If the currents flowing from the source transistors 430 and 434 are not initially matched, the resistors 440 and 442 produce a discrepancy in gate voltages at the gate terminals 458 and 450 of the transistors 452 and 444. Because of the closely spaced and closely matched characteristics of the resistors 440 and 442, the discrepancy in the gate voltages is preserved. However, since the source terminals 446 and 454 are tied to a common electrical potential (i.e., voltage level), the gate voltages are forced to match, thereby yielding matched currents flowing from the transistors 430 and 434.

As further shown in the embodiment of FIG. 4, the left-most column transistor 414*a* of the left end of group driver circuit 120*b* is typically physically located near the source transistor 434. Similarly, the right-most column transistor 414*e* of the right end of group driver circuit 120*a* is typically physically located near the source transistor 430. Therefore, any differences in currents flowing through transistors 414*a* and 434 (or currents flowing through transistors 414*e* and 430) are minimized due to their close physical proximity on the integrated circuit.

In one embodiment, the transistors referred to herein may be of the class of transistors well known in the technology as Field Effect Transistors ("FET"). FET's are comprised of 3 terminals, referred to as the gate terminal, source terminal and drain terminal. The three terminals are also referred to by the corresponding shorthand notation of gate, source and drain. In another embodiment, the transistors may be of the class of transistors well known in the technology as Bipolar Junction Transistors (BJT). BJT's are comprised of three terminals, referred to in the description and depicted in the figures as the base terminal, collector terminal and emitter terminal. Additionally, the terminals are also referred to by the corresponding shorthand notation of base, collector and emitter. However, other classes of transistors or other electronic devices are also within the scope of the present invention.

In one embodiment, the value of the matched resistors 440 and 442 is 10K ohms, but other values may operate at least as well. In another embodiment, the value of the series resistors 464 is 1K Ohms, but other values may operate at least as well. In a further embodiment, the value of the resistors 460, 482, 484, 486 and 488 is 1K Ohms, but other values may operate at least as well.

In the embodiment shown in FIG. 4, the current balancing circuit 400 compensates for differences in current sources between the two end columns of two adjacent group driver circuits 120*a* and 120*b*, labeled "COL1" 410*a* and "COLN" 410*e* in FIG. 4. In another embodiment, the balancing circuit 400 balances the currents through columns in a region of adjacent end columns 410*a* and 410*e*. The region of adjacent end columns in this embodiment refers to one, two, three, four or five end columns, or a greater number of columns so that the image quality of the display device 100 is improved. In another embodiment, current balancing in the region of adjacent end columns refers to any number of columns in the group driver circuits 120*a* and 120*b* that results in balanced currents through adjacent end columns 410*a* and 410*e*, or through any desired number of columns. In a further embodiment, current balancing in the region of the end columns refers to any number of columns in the group driver circuit 120*a* and 120*b* that results in balanced currents through the columns in the vicinity of the end columns 410*a* and 410*e*. It is likely that the further from the end columns the current balancing is performed the greater the corresponding degradation in display quality.

Figure 5:
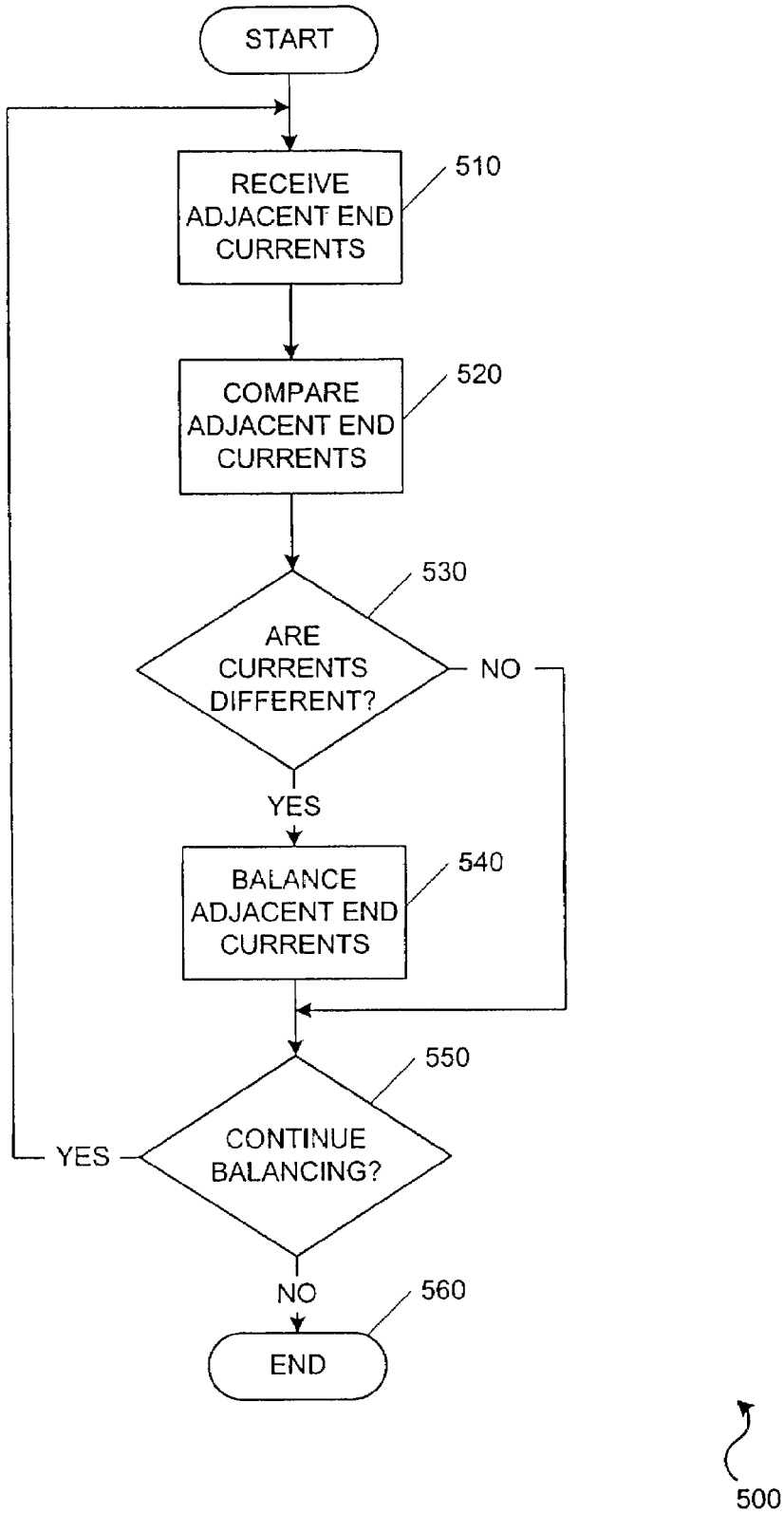
FIG. 5 is a flowchart of a process of balancing adjacent end currents in accordance with one embodiment of the balancing circuit of FIG. 4.

FIG. 5 is a flowchart of a process 500 of balancing adjacent end currents in accordance with one embodiment of the balancing circuit 400 of FIG. 4. At block 510, the matched transistors 444 and 452 are configured to supply currents to adjacent end regions of two different group driver circuits 120 (as described above in relation to FIG. 4). More particularly, the drain terminals 448 and 456 supply currents to the mirror transistors 436 and 432, respectively, and the gate terminals 450 and 458 receive currents from the source transistors 430 and 434, respectively. The matched resistors 440 and 442 are also configured to receive currents from one end region of two adjacent group driver circuits 120. At block 520, the balancing circuit 400 is configured to compare currents received from end regions of adjacent group driver circuits 120. In this embodiment, the balancing circuit 400 may include a processor (e.g., a programmable processor or an application specific integrated circuit, not shown) that is programmed with instructions to compare currents from said end regions of two adjacent group driver circuits 120. At decision block 530, the processor of the balancing circuit 400 may determine if the comparison of adjacent end region currents produces a difference in said adjacent end currents. If so, the process continues to block 540, described below; otherwise, the process continues directly to block 550, which is also described below.

In the case where the currents in adjacent end regions are of different values, at block 540 the balancing circuit 400 may utilize the processor, or the combination of the matched transistors 444 and 452 and resistors 440 and 442 (as described above), to balance the adjacent end currents by compensating for the difference in currents in the adjacent end regions. This results in balanced currents at both end regions of two adjacent group driver circuits 120. This in turn results in balanced currents flowing through the drain terminals 448 and 456 of the matched transistors 444 and 452 from the current mirror transistors 432 and 436. As described above, this produces balanced currents flowing through each of the column transistors 414 near the end regions of two adjacent group driver circuits 120. At block 550, the balancing circuit 400 determines whether to continue balancing adjacent end region currents or not. In one embodiment, the balancing circuit 400 may perform the current balancing process at power-up or upon a reset of the display device 100. In another embodiment, the balancing circuit 400 may perform the current balancing process at predetermined time intervals during normal operation of the display device 100. If further current balancing is desired, the process returns to block 510. Otherwise, the balancing process terminates after block 560.

In one embodiment, the current balancing circuit 400 compensates for differences in current sources between the two end columns of two adjacent group driver circuits 120, labeled "COL1" 410*a* and "COLN" 410*e* in FIG. 4. In another embodiment, the balancing circuit 400 balances the currents through columns in a region of adjacent end columns 410*a* and 410*e*. The region of adjacent end columns in this embodiment refers to one, two, three, four or five end columns, or a greater number of columns so that the image quality of the display device 100 is improved. In another embodiment, current balancing in the region of adjacent end columns refers to any number of columns in the group driver circuits 120 that results in balanced currents through adjacent end columns 410*a* and 410*e*, or through any desired number of columns. In a further embodiment, current balancing in the region of the end columns refers to any number of columns in the group driver circuit 120 that results in balanced currents through the columns in the vicinity of the end columns 410*a* and 410*e*. It is likely that the further from the end columns the current balancing is performed the greater the corresponding degradation in display quality.

One skilled in the technology will appreciate that the invention is also not limited to the embodiments illustrated by FIGS. 4 and 5, and may be utilized in conjunction with other current balancing embodiments for adjacent display driver circuits not here disclosed. In addition, the functionality of the components of FIG. 4 may be combined into fewer components, different components, or further separated into additional components. The components may additionally be implemented to execute on one or more components. As noted above, the current balancing circuit 400 may utilize a processor or an application specific integrated circuit (ASIC) device. In the case of a current balancing circuit 400 executing on a processor, the processor may be programmed with instructions, for example computer code. In other embodiments, some of the components may be implemented to execute on one or more components external to the group driver circuits 120 or current balancing circuit 400.

Figure 6:
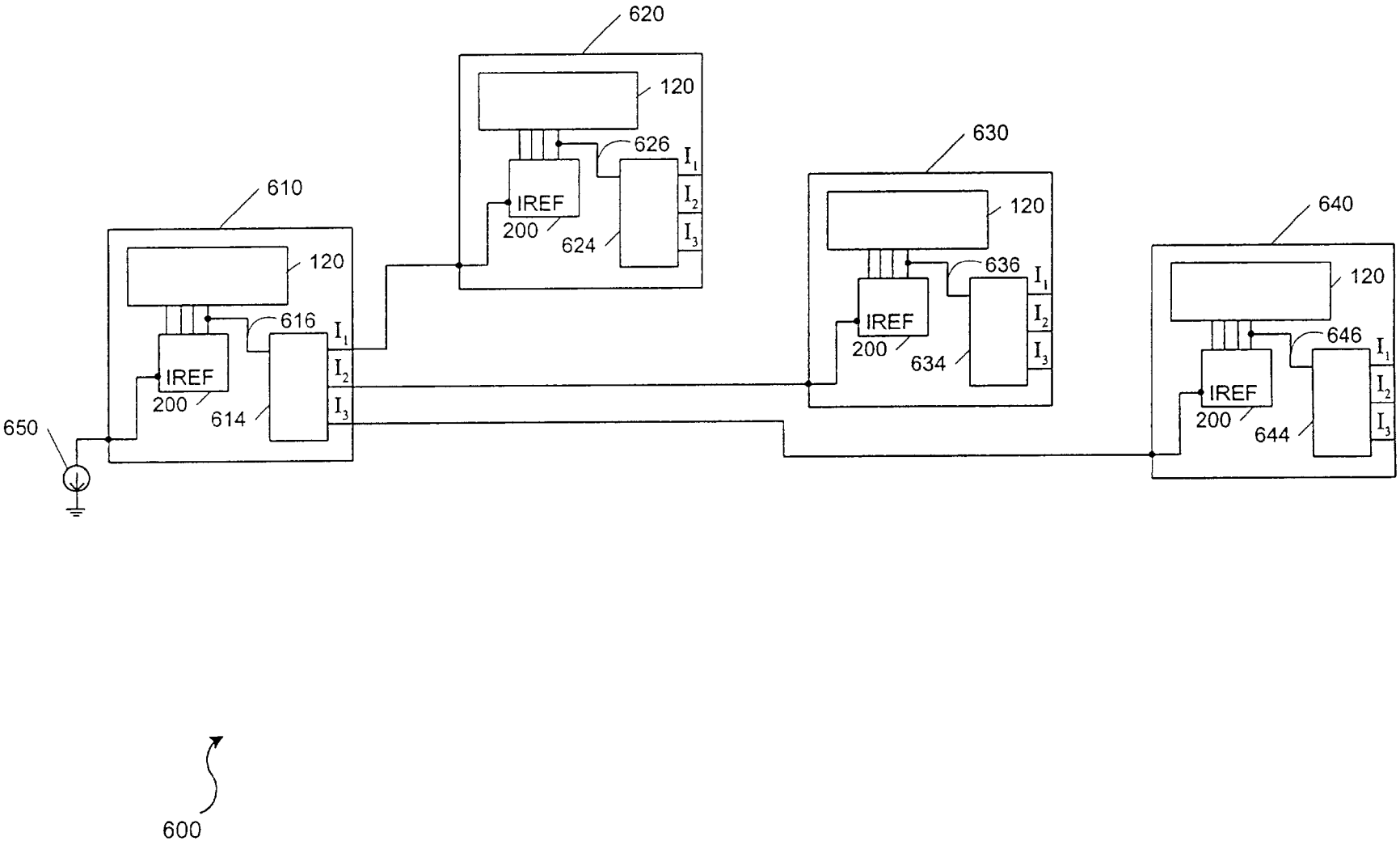
FIG. 6 is a block diagram of one embodiment of the balancing circuit of FIG. 2 configured in a cascaded circuit.

FIG. 6 is a block diagram of one embodiment of the balancing circuit 200 of FIG. 2 configured in a cascaded circuit 600. In this embodiment, the cascaded circuit 600 comprises a driver circuit 610 designated as the master circuit. The master driver circuit 610 comprises the group driver circuit 120 (see FIG. 1), which is electrically connected to the reference current source labeled as 'IREF.' The master driver circuit 610 may further comprise the balancing circuit 200, which is electrically connected to the group driver circuit 120. For information on the connection and operation of the group driver circuit 120 and the balancing circuit 200, see FIG. 2 and the related description above. As indicated in the description, one end region of the group driver circuit 120 generates a current and thus a voltage potential at an electrical connection 616 as shown in FIG. 6. The master driver circuit 610 further comprises a current mirror circuit 614, which is electrically connected to the group driver circuit 120 and the balancing circuit 200 at the electrical connection 616. The current mirror circuit 614, as will be appreciated by one of ordinary skill in the technology, is typically used in the technology to provide one or more currents that is substantially the same as the source current as labeled by 'IREF' in master driver circuit 610. The current mirror circuit 614 may produce one or more currents, for example, as shown in FIG. 6, three currents are produced as labeled by 'I1,' 'I2,' and 'I3' in the master circuit 610. The currents 'I1,' 'I2,' and 'I3' are produced to be substantially matched to the current labeled by 'IREF' in FIG. 6. Although three current references sources are shown in the embodiment of FIG. 6, greater or lesser numbers of current reference sources are also within the scope of the present invention.

The cascaded circuit 600 further comprises one or more slave driver circuits 620, 630 and 640. Although the embodiment shown in FIG. 6 comprises three slave circuits, a greater or lesser number of slave circuits is also within the scope of the present invention. The slave driver circuit 620 comprises the group driver circuit 120 (see FIG. 1), which is electrically connected to the source current labeled at 'IREF.' The slave driver circuit 620 further comprises the balancing circuit 200, which is electrically connected to the group driver circuit 120. For more information on the connection and operation of the group driver circuit 120 and the balancing circuit 200, see FIG. 2 and the related description above. The slave driver circuit 620 further comprises a current mirror circuit 624, which is electrically connected to the group driver circuit 120 and the balancing circuit 200 at an electrical connection 626. The output currents of the current mirror circuit 624, as labeled by 'I1,' 'I2,' and 'I3' in the slave circuit 620, may not be used but are shown in FIG. 6 to illustrate the possibly similar circuit configuration of the master circuit 610 with the slave circuit 620, so that manufacturing of multiple slave circuits 620 is accomplished without having to change the master circuit 610. The cascaded circuit 600 may further comprise one or more additional slave driver circuits 630 and 640, which are connected and operate similarly to the description provided above for slave driver circuit 620.

As shown in FIG. 6, the current 'I1' of the current mirror circuit 614 may be connected as a reference to the balancing circuit 200 of the slave circuit 620. Similarly, the current 'I2' of the current mirror circuit 614 may be connected to the balancing circuit 200 of the slave circuit 630. Likewise, the current 'I3' of the current mirror circuit 614 may be connected to the balancing circuit 200 of the slave circuit 640. This configuration of connecting the slave circuits 620, 630 and 640 in the cascaded manner shown in FIG. 6 enables more accurate current sources and reduces one source of error in the cascaded circuit 600. These more accurate current sources enable closer matching of the currents between and within adjacent driver circuits 610, 620 and 630. In the visual display device embodiment, a higher quality, more useful, and more desirable display device is likely produced.

Figure 7:
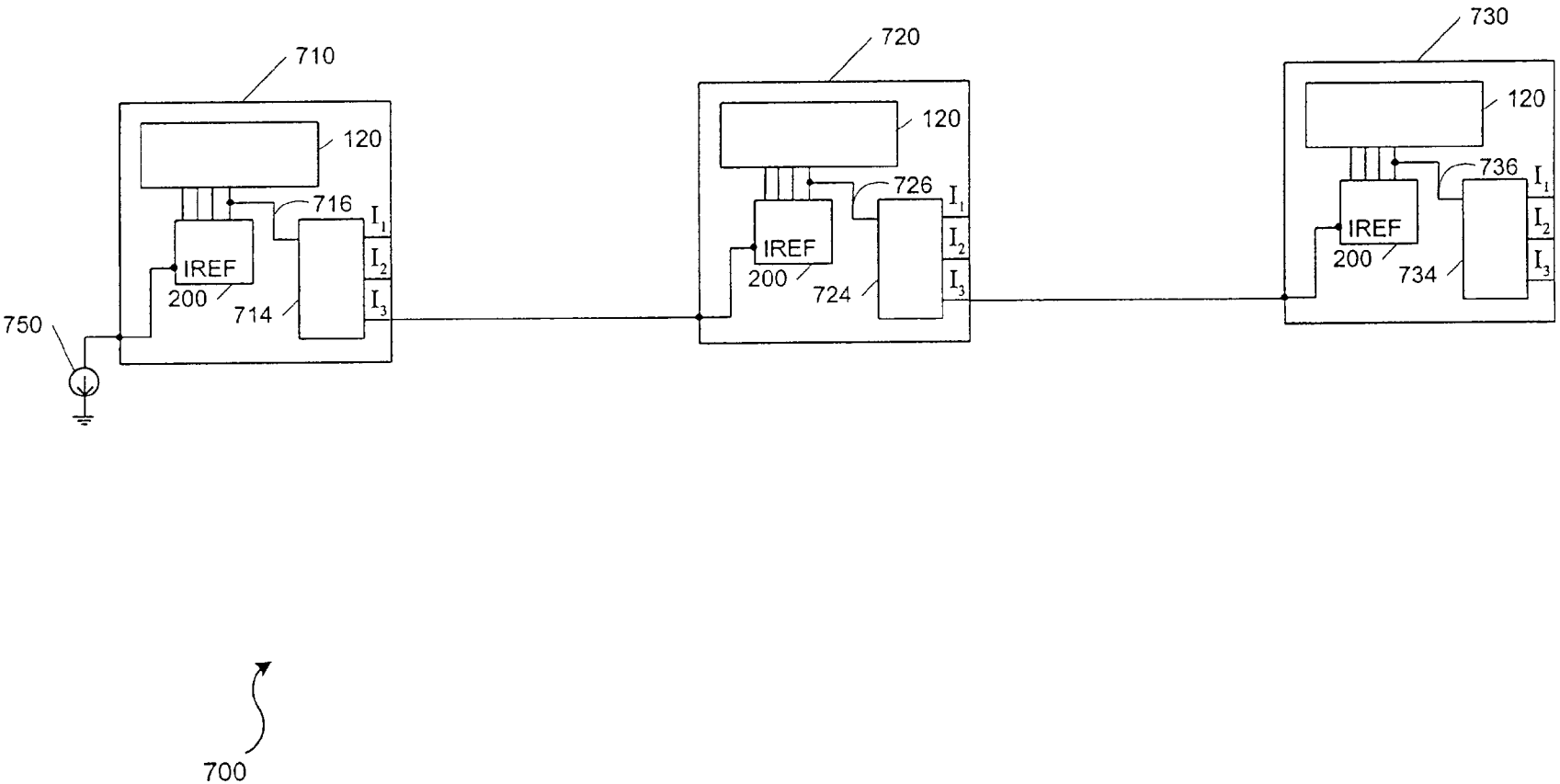
FIG. 7 is a block diagram of one embodiment of the balancing circuit of FIG. 2 configured in a daisy-chained circuit.

FIG. 7 is a block diagram of one embodiment of the balancing circuit 200 of FIG. 2 configured in a daisy-chained circuit 700. In this embodiment, the daisy-chained circuit 700 comprises a driver circuit 710 designated as the master circuit. The master driver circuit 710 comprises the group driver circuit 120 (see FIG. 1), which is electrically connected to the reference current source labeled at 'IREF.' The master driver circuit 710 may further comprise the balancing circuit 200, which is electrically connected to the group driver circuit 120. For information on the connection and operation of the group driver circuit 120 and the balancing circuit 200, see FIG. 2 and the related description above. As indicated in the description, one end region of the group driver circuit 120 generates a current and thus a voltage potential at an electrical connection 716 as shown in FIG. 7. The master driver circuit 710 further comprises a current mirror circuit 714, which is electrically connected to the group driver circuit 120 and the balancing circuit 200 at the electrical connection 716. The current mirror circuit 714, as will be appreciated by one of ordinary skill in the technology, is typically used in the technology to provide one or more currents that is substantially the same as a source current as labeled by 'IREF' in master driver circuit 710. The current mirror circuit 714 may produce one or more currents, for example, as shown in FIG. 7, three currents are produced as labeled by 'I1,' 'I2,' and 'I3' in the master circuit 710. The currents 'I1,' 'I2,' and 'I3' are produced to be substantially matched to an input current labeled by 'I' in FIG. 7. Although three current references sources are shown in the embodiment of FIG. 7, greater or lesser numbers of current reference sources are also within the scope of the present invention.

The daisy-chained circuit 700 further comprises one or more slave driver circuits 720 and 730. Although the embodiment shown in FIG. 7 comprises two slave circuits, a greater or lesser number of slave circuits is also within the scope of the present invention. The slave driver circuit 720 comprises the group driver circuit 120 (see FIG. 1), which is electrically connected to the source current labeled at 'IREF.' The slave driver circuit 720 further comprises the balancing circuit 200, which is electrically connected to the group driver circuit 120. For more information on the connection and operation of the group driver circuit 120 and the balancing circuit 200, see FIG. 2 and the related description above. The slave driver circuit 720 further comprises a current mirror circuit 724, which is electrically connected to the group driver circuit 120 and the balancing circuit 200 at an electrical connection 726. The output currents of the current mirror circuit 724, as labeled by 'I1' and 'I2' in the slave circuit 720, may not be used but are shown in FIG. 7 to illustrate the possibly similar circuit configuration of the master circuit 710 with the slave circuit 720, so that manufacturing of multiple slave circuits 720 is accomplished without having to change the master circuit 710. The daisy-chained circuit 700 may further comprise one or more additional slave driver circuits 730, each are connected and operate similarly to the description just stated for slave driver circuit 720.

The current 'I3' of the current mirror circuit 714 may be connected to the balancing circuit 200 of the slave circuit 720. In this embodiment, currents 'I1' and 'I2' of current mirror circuit 714 may not be used. This configuration of connecting the slave circuits 720 and 730 in the daisy-chained manner shown in FIG. 7 enables more accurate current sources and reduces one source of error in the daisy-chained circuit 700. These more accurate current sources enable closer matching of the currents between and within adjacent driver circuits 710, 720 and 730. In the visual display device embodiment, a higher quality, more useful, and more desirable display device is likely produced.

Figure 8:
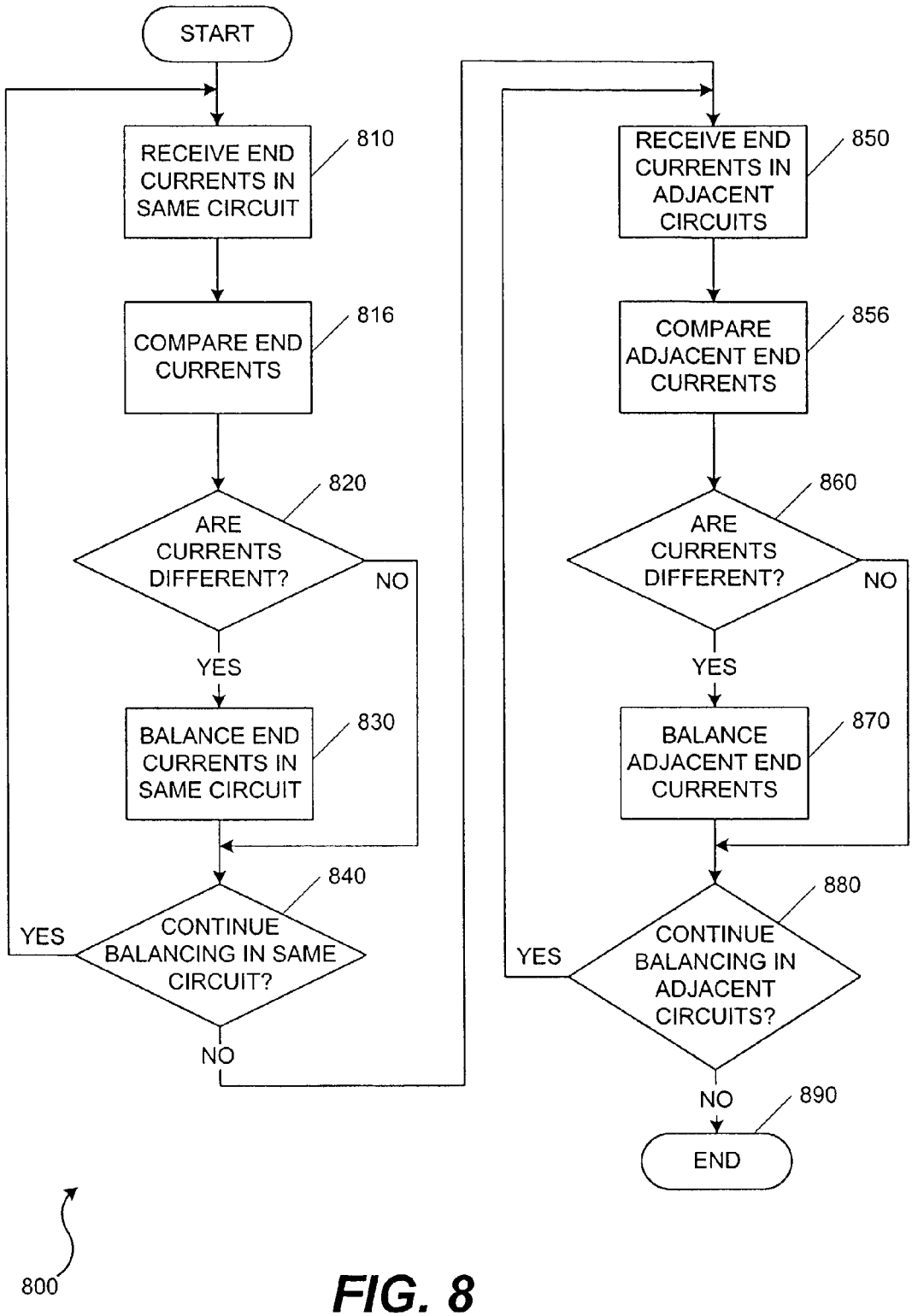
FIG. 8 is a flowchart of a process of balancing currents across a display area of a visual display device in accordance with one embodiment of the balancing circuits of FIGS. 2 and 4.

FIG. 8 is a flowchart of a process 800 of balancing currents across a display area of a visual display device in accordance with an embodiment of the balancing circuits 200 and 400 shown in FIGS. 2 and 4. At block 810, each of the matched transistors 244 and 252 (see FIG. 2) is configured to supply currents to the end regions of the group driver circuit 120. More particularly, the drain terminals 248 and 256 supply currents to the mirror transistors 232 and 236, respectively, and the gate terminals 250 and 258 receive currents from the source transistors 230 and 234, respectively. In a further embodiment, the matched resistors 240 and 242 perform the step of receiving currents from the end regions of the group driver circuit 120. At block 816, the balancing circuit 200 is configured to compare currents received from end regions of the group driver circuit 120. In this embodiment, the balancing circuit 200 may include a processor (e.g., a programmable processor or an application specific integrated circuit, not shown) that is programmed with instructions to compare currents from said end regions. At decision block 820, the processor of the balancing circuit 200 determines if the comparison of end region currents produces a difference in said end currents. Whether the end region currents are different is determined by the precision of the current matching that is desired to be achieved in the particular embodiment. If the end region currents are different, the process continues to block 830, described below; otherwise, the process continues directly to block 840, which is also described below.

In the case where the currents in the end regions are of different values, at block 830 the balancing circuit 200 may utilize the processor, or the combination of the matched transistors 244 and 252 and resistors 240 and 242 (as described above), to balance the end currents by compensating for the difference in currents in the end regions. This results in balanced currents at both end regions of the group driver circuit 120. This in turn results in balanced currents flowing through the drain terminals 248 and 256 of the matched transistors 244 and 252 from the current mirror transistors 232 and 236. This produces balanced currents flowing through each of the column transistors 214. At decision block 840, the balancing circuit 200 determines whether to continue balancing end region currents. In one embodiment, the balancing circuit 200 may perform the current balancing process at power-up or reset of the display device 100. In another embodiment, the balancing circuit 200 may perform the current balancing process at predetermined time intervals during normal operation of the display device 100. If further current balancing is desired, the process returns to block 810. Otherwise, the balancing process continues to block 850 as described below.

In one embodiment, the current balancing circuit 200 compensates for differences in current sources between the two end columns of the group driver circuit 120, labeled "COL1" 210*a* and "COLN" 210*e* in FIG. 2. In another embodiment, the balancing circuit 200 balances the currents through columns in a region of the end columns 210*a* and 210*e*. The region of the end columns in this embodiment refers to one, two, three, four or five end columns, or a greater number of columns so that the image quality of the display device 100 is improved. In another embodiment, current balancing in the region of the end columns refers to any number of columns in the group driver circuit 120 that results in balanced currents through the end columns 210*a* and 210*e*, or through any desired number of columns. In a further embodiment, current balancing in the region of the end columns refers to any number of columns in the group driver circuit 120 that results in balanced currents through the columns in the vicinity of the end columns 210*a* and 210*e*. It is likely that the further from the end columns the current balancing is performed the greater the corresponding degradation in display quality.

At block 850, the matched transistors 444 and 452 (see FIG. 4) are configured to supply currents to adjacent end regions of two different group driver circuits 120*a* and 120*b* (as described in connection with FIG. 4 above). More particularly, the drain terminals 448 and 456 supply currents to the mirror transistors 436 and 432, respectively, and the gate terminals 450 and 458 receive currents from the source transistors 430 and 434, respectively. The matched resistors 440 and 442 are also configured to receive currents from one end region of two adjacent group driver circuits 120*a* and 120*b*. At block 856, the balancing circuit 400 is configured to compare currents received from end regions of adjacent group driver circuits 120*a* and 120*b*. In this embodiment, the balancing circuit 400 may include a processor (e.g., a programmable processor or an application specific integrated circuit, not shown) that is programmed with instructions to compare currents from said end regions of two adjacent group driver circuits 120*a* and 120*b*. At decision block 860, the processor of the balancing circuit 400 may determine if the comparison of adjacent end region currents produces a difference in said adjacent end currents. If so, the process continues to block 870, described below; otherwise, the process continues directly to block 880, which is also described below.

In the case where the currents in adjacent end regions are of different values, at block 870 the balancing circuit 400 may utilize the processor, or the combination of the matched transistors 444 and 452 and resistors 440 and 442 (as described above), to balance the adjacent end currents by compensating for the difference in currents in the adjacent end regions. This results in balanced currents at both end regions of two adjacent group driver circuits 120*a* and 120*b*. This in turn results in balanced currents flowing through the drain terminals 448 and 456 of the matched transistors 444 and 452 from the current mirror transistors 432 and 436. As described above, this produces balanced currents flowing through each of the column transistors 414 near the end regions of two adjacent group driver circuits 120*a* and 120*b*. At decision block 880, the balancing circuit 400 determines whether to continue balancing adjacent end region currents. In one embodiment, the balancing circuit 400 may perform the current balancing process at power-up or upon a reset of the display device 100. In another embodiment, the balancing circuit 400 may perform the current balancing process at predetermined time intervals during normal operation of the display device 100. If further current balancing of adjacent ends is desired, the process returns to block 850. Otherwise, the balancing process terminates at block 890.

Figure 9:
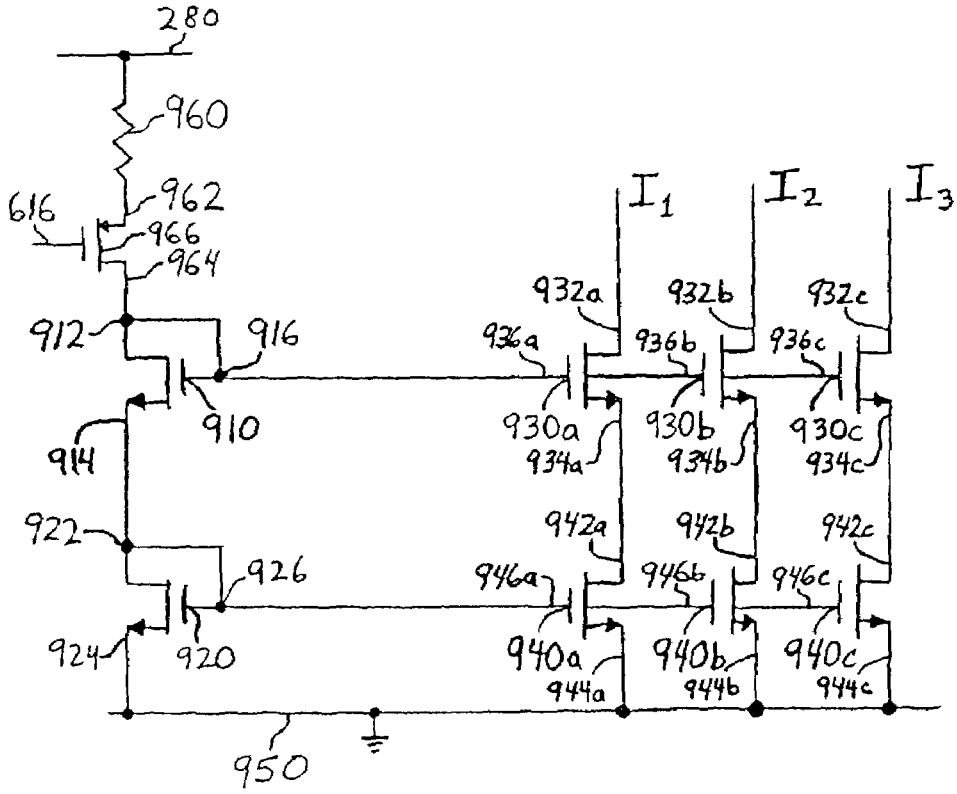
FIG. 9 is a schematic diagram of one embodiment of a current mirror circuit that may be used in the embodiments shown in FIGS. 6 and 7.

FIG. 9 is a schematic diagram of one embodiment of a current mirror circuit 614 that may be used in the embodiments shown in FIGS. 6 and 7. The configuration of the current mirror circuit 614 embodiment of FIG. 9, referred to in the technology as a cascode current source circuit, will be understood by one of ordinary skill in the technology. The current mirror circuit 614 embodiment of FIG. 9 comprises transistors referred to in the technology as Metal-Oxide-Semiconductor Field-Effect-Transistor ("MOSFET") devices, but other embodiments may include other types of transistor devices. While the current mirror circuit is labeled with reference number 614 in FIG. 9 and in the description herein, it may also be used as the current mirror circuit for the circuits labeled with reference numbers 624, 634, 644, 714, 724 and 734 as shown in FIGS. 6 and 7.

The current mirror circuit 614 embodiment shown in FIG. 9 comprises a source transistor 966. A source terminal 962 of the source transistor 966 is connected to a lower end (in relation to FIG. 9) of a resistor 960. An upper end of the resistor 960 is connected to the common electrical connection 280 (see FIG. 2). The source transistor 966 has a gate terminal 616 that is connected to the common electrical connection at points 276, 290, 292 and 248 as shown in FIGS. 2.

The current mirror circuit 614 embodiment shown in FIG. 9 further comprises a diode-connected transistor 910. A drain terminal 912 of the transistor 910 is connected to the source terminal 964 of the transistor 966. The current mirror circuit 614 further comprises a diode-connected transistor 920. A source terminal 914 of the transistor 910 is connected to a drain terminal 922 of the transistor 920. A source terminal 924 of the transistor 920 is connected to a common electrical ground 950. The drain terminal 912 of the transistor 910 is electrically connected to its own gate terminal 916. Similarly, the drain terminal 922 of the transistor 920 is electrically connected to its own gate terminal 926. The transistors 910 and 920 are referred to in the technology as diode-connected transistors due to this electrical connection (i.e. shorted to a common electrical point having the same voltage potential) between the drain terminal 912 and 922 and the gate terminal 916 and 926, respectively.

The current mirror circuit 614 further comprises diode-connected transistors 940*a*, 940*b*, and 940*c* (hereinafter collectively referred to as "940"). Although the embodiment of FIG. 9 shows three of these transistors 940, other embodiments may include fewer or more of the transistors 940, depending on the number of current sources desired. Gate terminals 946*a*, 946*b* and 946*c* (hereinafter collectively referred to as "946") are connected to the gate terminal 926 of the transistor 920. Source terminals 944*a*, 944*b*, and 944*c* (hereinafter collectively referred to as "944") are connected to the common electrical ground 950.

The current mirror circuit 614 further comprises transistors 930*a*, 930*b*, and 930*c* (hereinafter collectively referred to as "930"). Although the embodiment of FIG. 9 shows three of these transistors 930, other embodiments may include fewer or more of the transistors 930, depending on the number of current sources desired. While the number of transistors 940 and 930 may be different for various embodiments, the number of transistors 940 is typically equivalent to the number of transistors 930. Gate terminals 936*a*, 936*b* and 936*c* of the transistors 930 are connected to the gate terminal 916 of the transistor 910. Source terminals 934*a*, 934*b*, and 934*c* of the transistors 930 are connected to drain terminals 942*a*, 942*b*, and 942*c*, respectively, of the transistors 940. Drain terminals 932*a*, 932*b*, 932*c* of the transistors 930 are the current sources labeled as 'I1', 'I2' and 'I3' in FIG. 9.

The operation of the current mirror circuit 614 embodiment of FIG. 9, generally referred to in the technology as a cascode current source circuit, will be understood by one of ordinary skill in the technology. The current source transistor 966 generates a reference current, referred to as 'IREF,' which flows to the drain terminal 912 of the diode-connected transistor 910. The current flows from the drain terminal 912 through the transistor 910 to the source terminal 914. The current flowing from the source terminal 914 is substantially equivalent to the current flowing to the drain terminal 922 of the diode-connected transistor 920 due to the uninterrupted single connection between the source terminal 914 and the drain terminal 922 as shown in FIG. 9. The current flows from the drain terminal 922 through the transistor 920 to the source terminal 924. Therefore, the current flowing through transistors 910 and 920 is substantially equivalent to the reference current 'IREF' generated by the current source transistor 966 since the single current path from the transistor 966 to the common electrical ground 950 is through the transistors 910 and 920.

The transistors 910 and 920 are referred to as diode-connected transistors due to their drain terminals 912 and 922 being electrically connected (i.e. shorted to a common electrical point having the same voltage potential) to the gate terminals 916 and 926, respectively. Therefore, at a given current level for the reference current 'IREF', the gate to source voltage is established for the transistors 910 and 920 due to the substantially equivalent current flowing through the transistors and the substantially equivalent voltage potential at the drain terminals 912 and 922 and the gate terminals 916 and 926. The transistors 920 and 940 have substantially equivalent gate to source voltages, regardless of the number of transistors 940 comprising a particular embodiment, due to the gate terminals 946 being connected to the common voltage potential at the gate terminal 926 of the transistor 920, and the source terminals 924 and 944 being connected to the common electrical ground 950.

Therefore, due to the substantially equivalent gate to source voltages of the transistors 920 and 940, the current flowing through the transistors 920 and 940 is substantially equivalent. As described above, since the current flowing through the transistor 920 is substantially equivalent to the reference current 'IREF', the current flowing through transistors 940 is thus also substantially equivalent to the reference current 'REF'. This substantial equivalence of the reference current 'IREF' to the currents flowing through transistors 940 is referred to in the technology as the reference current 'IREF' being mirrored in the transistors 940.

The currents flowing through the transistors 940 may potentially vary by some small amount if the voltages at the drain terminals 942 of the transistors 940 are not substantially equivalent. In certain embodiments, a typical variation of the currents through transistors 940 may be in the area of ±5%, although other variations are also possible. The current mirror circuit 614 includes the transistors 930 to establish substantially equivalent drain voltages at the transistors 940. As described above, at a given current level for the reference current 'IREF', the gate to source voltage is established for the transistor 910, which is substantially equivalent to the drain to source voltage due to the diode connection between the drain terminal 912 and the gate terminal 916. In the embodiment shown in FIG. 9, the transistors 910 and 920 have substantially the same electrical characteristics, although transistors of various electrical characteristics may be used so long as they are substantially equivalent to one another. Since the current flowing through transistors 910 and 920 is substantially the same and because of the diode connection of the transistors 910 and 920, as described above, the gate to source voltages of the transistors 910 and 920 are substantially equivalent.

The current flowing through transistors 930*a* and 940*a* is substantially equivalent due to the single current path from the current source 'I1' to the common electrical ground 950 through the transistors 930*a* and 940*a*. Similarly, the current flowing through transistors 930*b* and 940*b* is substantially equivalent, as is the current through transistors 930*c* and 940*c*. For embodiments containing more than the three current sources and the three transistor pairs 930 and 940 shown in FIG. 9, the currents through the transistors 930 and 940 would similarly be substantially equivalent. As described above, the current through the transistors 940 is substantially equivalent to the current through the transistor 920, and the current flowing through the transistors 930 is substantially equivalent to the current flowing through the transistors 940. Therefore, the current flowing through the transistors 930 is substantially equivalent to the current flowing through the transistors 910 and 920, which is substantially equivalent to the reference current 'IREF'.

Since, as described above, the current flowing through the transistors 910 and 930 is substantially the same, and the gate terminals 916 and 936 are tied to a common electrical connection, the gate to source voltages of the transistors 910 and 930 are substantially equivalent. Similarly, since the gate to source voltages of the transistors 910 and 920 are substantially equivalent, as described above, the gate to source voltages of the transistors 930 and 940 are substantially equivalent. The gate to source voltages of the transistors 910 and 930 thereby force the drain voltage of the transistor 940 to be substantially equivalent to the drain voltage of the transistor 920. Thus, the gate to source voltage of the transistors 940 is substantially equivalent to the gate to source voltage of the transistor 920.

Therefore, since the three terminal voltages of the transistors 920 and 940 are substantially equivalent, as described above, the current flowing through the transistors 920 and 940 is substantially equivalent. The currents 'I1', 'I2' and 'I3' shown in the embodiment of FIG. 9 mirror the reference current 'IREF', producing the desired current mirror circuit 614. In addition, the transistors 940 in the embodiment of FIG. 9 may be selected to have a relatively high output impedance, which produces a well-controlled and substantially equivalent current irrespective of the voltage at the drain terminals 932 of the transistors 930, because of the driving of the drain terminals 942 of the transistors 940 as described above.

To summarize the operation of the current mirror circuit 614 shown in the embodiment of FIG. 9, the transistors 920 and 940 are configured to mirror the reference current 'IREF' since they have the same gate to source voltages. The output impedance of the transistors 920 and 940 is improved by the addition of the transistors 910 and 930, which control the drain voltage of the transistors 940. As shown in the embodiment of FIG. 9, currents 'I1', 'I2' and 'I3' that mirror reference current 'IREF' are produced that flow from the current mirror circuit 614 to external circuits, for example the balancing circuit 200 shown in FIGS. 6 and 7.

The current mirror circuit 614 shown in FIG. 9 is referred to in the technology as a current source circuit. A further embodiment of the current mirror circuit 614 is referred to in the technology as a current sink circuit. In this embodiment, currents 'I1', 'I2' and 'I3' that mirror reference current 'IREF' are drawing from a load external to the current mirror circuit 614 and brought in through the transistors 930 and 940 to ground at the common electrical ground 950. The current sink circuit operates in a similar way as described above for the current source circuit, except for the connection of the source transistor 966 being reversed and the opposite direction of the flow of currents 'I1', 'I2' and 'I3' that results. Other embodiments of the current mirror circuit 614, for example the current sink circuit, may be implemented in certain embodiments of the cascaded circuit 600 and the daisy-chained circuit 700.

Figure 10:
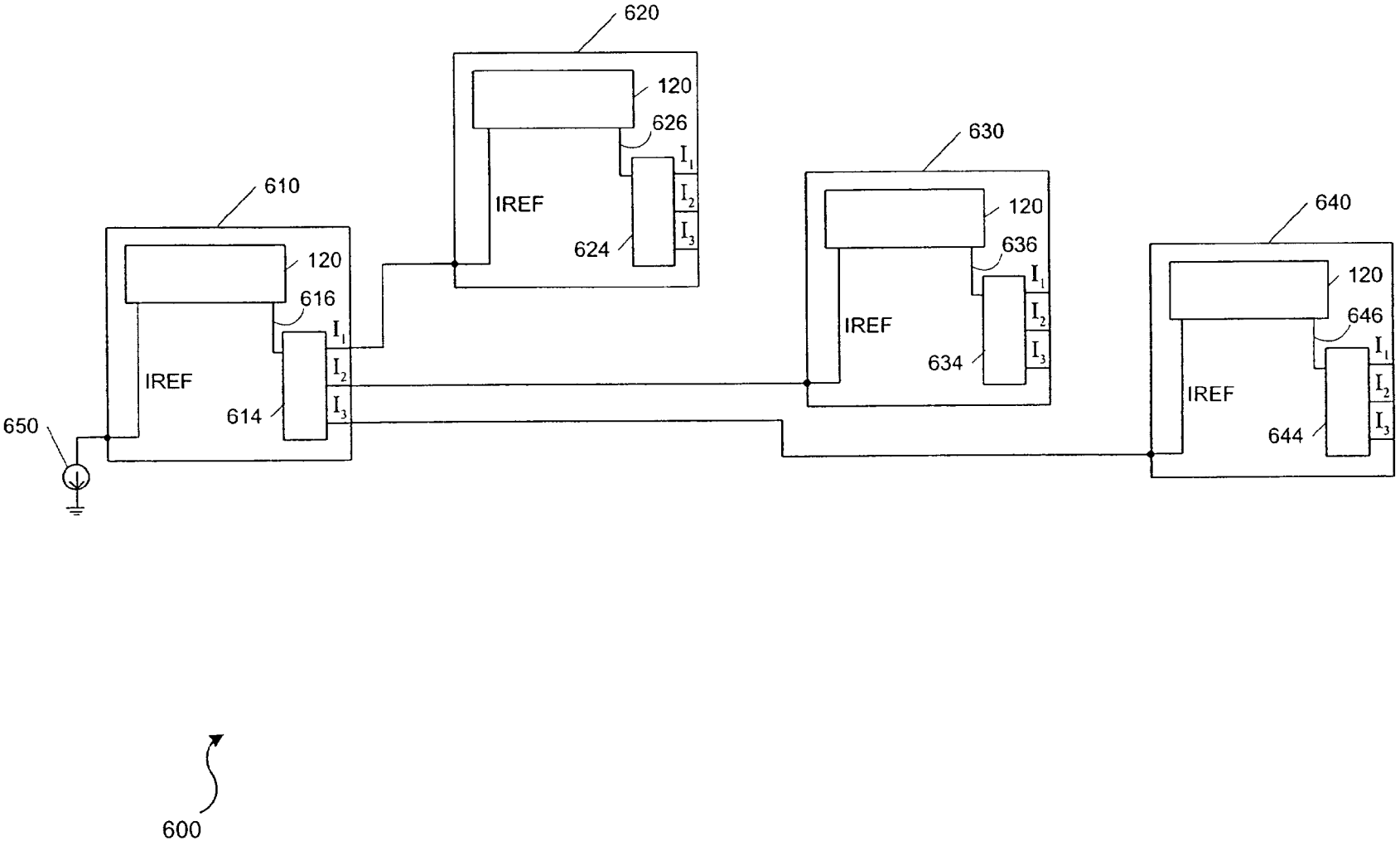
FIG. 10 is a block diagram of an alternative embodiment of the cascaded circuit shown in FIG. 6.

FIG. 10 is a block diagram of an alternative embodiment of the cascaded circuit 600 shown in FIG. 6. In this embodiment, the balancing circuit 200 may be removed from any or all of the driver circuits 610, 620, 630 and 640. As shown in FIG. 10, there are two electrical connections to the group driver circuit 120, one labeled as 'REF' and the other as electrical connection 616, 626, 636, and 646, respectively. In this embodiment, the electrical connection labeled as 'IREF' connects to the left end region (in relation to FIG. 10) of the group driver circuit 120. The electrical connections 616, 626, 636, and 646 are connected to the right end regions of the group driver circuits 120 in each of the driver circuits 610, 620, 630 and 640, respectively. Other than the differences noted above, the cascaded circuit 600 embodiment in FIG. 10 is connected and operates similarly to the cascaded circuit 600 shown in FIG. 6 and in the corresponding description of FIG. 6 above.

Figure 11:
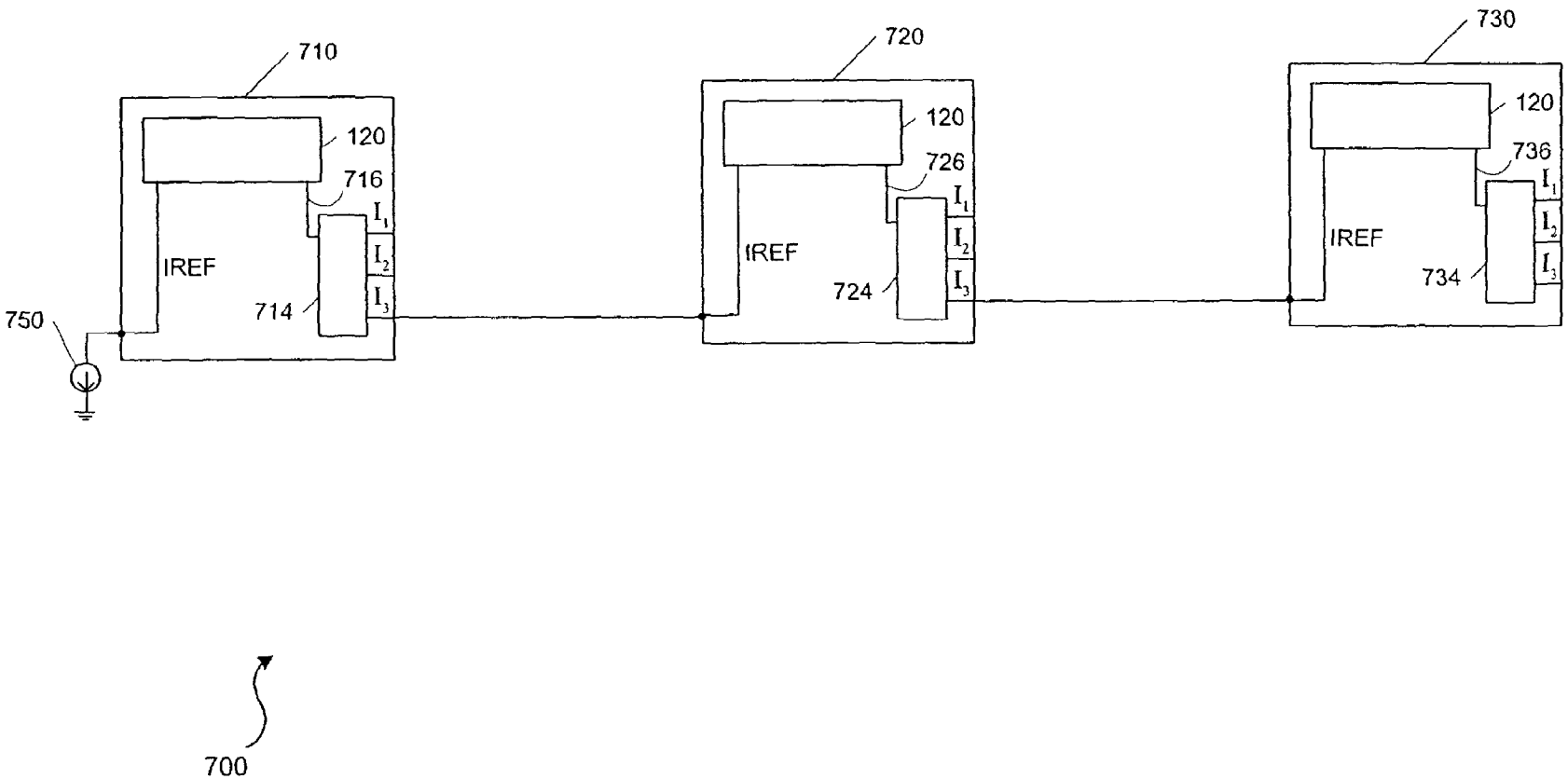
FIG. 11 is a block diagram of an alternative embodiment of the daisy-chained circuit shown in FIG. 7.

FIG. 11 is a block diagram of an alternative embodiment of the daisy-chained circuit 700 shown in FIG. 7. In this embodiment, the balancing circuit 200 may be removed from any or all of the driver circuits 710, 720 and 730. As shown in FIG. 11, there are two electrical connections to the group driver circuit 120, one labeled as 'IREF' and the other as electrical connection 716, 726 and 736, respectively. In this embodiment, the electrical connection labeled as 'IREF' connects to the left end region (in relation to FIG. 11) of the group driver circuit 120. The electrical connections 716, 726 and 736 are connected to the right end regions of the group driver circuits 120 in each of the driver circuits 710, 720 and 730, respectively. Other than the differences noted above, the daisy-chained circuit 700 embodiment in FIG. 11 is connected and operates similarly to the daisy-chained circuit 700 shown in FIG. 7 and in the corresponding description of FIG. 7 above.

Thus, the invention overcomes the longstanding problems in the technology of current imbalance at the end columns of individual column driver circuits in visual display devices by providing a circuit for balancing the currents in the end region columns. A display device incorporating the column driver balancing circuit of the present invention thus has closely matched current through the columns in the end region of each driver circuit. This in turn allows balancing of the currents at the junction of adjacent columns driven by separate driver circuits, thereby eliminating any discernable discontinuity in brightness between areas across the entire display and resulting in a higher quality, more valuable display device.

While the above detailed description has shown, described, and pointed out novel features of the invention as applied to various embodiments, it will be understood that various omissions, substitutions, and changes in the form and details of the device or process illustrated may be made by those of ordinary skill in the technology without departing from the spirit of the invention. The scope of the invention is indicated by the appended claims rather than by the foregoing description. All changes which come within the meaning and range of equivalency of the claims are to be embraced within their scope.

What is claimed is:

1. An apparatus for balancing currents in a display device having at least first and second display areas, each including left and right end regions, the apparatus comprising:

a first driver circuit that is configured to generate a first current, the first driver circuit being configured to drive the first current substantially in the right end region of the first display area;

a second driver circuit that is configured to generate a second current, the second driver circuit being configured to drive the second current substantially in the left end region of the second display area; and a circuit that is configured to compare the first current to the second current, and to cause the first current to be substantially matched with the second current.

2. The apparatus as defined in claim 1, wherein the first and second driver circuits comprise column drivers of the display areas.

3. The apparatus as defined in claim 1, wherein the first driver circuit comprises a right end column driver of the first display area, and the second driver circuit comprises a left end column driver of the second display area.

4. The apparatus as defined in claim 3, wherein each of the left and right end column drivers comprises at least a resistor and a transistor.

5. The apparatus as defined in claim 1, wherein the display areas comprise a plurality of column drivers, each comprising at least a resistor and a transistor that are configured to drive a current to illuminate a plurality of pixels.

6. The apparatus as defined in claim 1, wherein the first driver circuit comprises one, two, three, four, and five adjacent right end column drivers of the first display area, and the second driver circuit comprises one, two, three, four, and five adjacent left end column drivers of the second display area.

7. The apparatus as defined in claim 1, wherein the first and second driver circuits are configured to drive light-emitting components of the display device.

8. The apparatus as defined in claim 7, wherein the light-emitting components comprise a plurality of organic light-emitting diodes.

9. The apparatus as defined in claim 1, wherein the right end region of the first display area includes a region of one to five right-hand columns, and the left end region of the second display area includes a region of one to five left-hand columns.

10. An apparatus for balancing currents in a display device having at least first and second display areas, each including left and right end regions, the apparatus comprising:

means for generating a first current, the means for generating a first current being configured to drive the first current substantially in the right end region of the first display area;

means for generating a second current, the means for generating a second current being configured to drive the second current substantially in the left end region of the second display area;

means for comparing the first current to the second current; and means for causing the first current to be substantially matched with the second current.

11. An apparatus for driving balanced currents in a display device having at least first and second display areas, the apparatus comprising:

a first driver circuit that is configured to generate a first current, the first driver circuit being configured to drive the first current substantially in the right end region of the first display area;

a current mirror circuit that is configured to receive the first current from the first driver circuit, and further configured to generate at least one mirrored current that is substantially equal to the first current;

a second driver circuit that is configured to generate a second current that is based at least in part on the mirrored current, the second driver circuit being configured to drive the second current substantially in the left end region of the second display area; and a balancing circuit that is configured to compare the mirror current to the second current and to cause the mirror current to be substantially matched with the second current.

12. The apparatus of claim 11, further comprising a third driver circuit that is configured to generate a third current, the third driver circuit being configured to drive the third current substantially in the left end region of the first display area.

13. The apparatus of claim 12, further comprising a matching circuit that is configured to cause the first current to be substantially matched with the third current.

14. The apparatus of claim 11, wherein the second current is substantially equal to the mirrored current.

15. The apparatus of claim 11, further comprising a fourth driver circuit that is configured to generate a fourth current, the fourth driver circuit being configured to drive the fourth current substantially in the right end region of the second display area.

16. The apparatus of claim 15, further comprising a matching circuit that is configured to cause the second current to be substantially matched with the fourth current.

17. The apparatus of claim 15, wherein the first driver circuit is part of a first group driver circuit, the second driver circuit is part of a second group driver circuit, and wherein the current mirror circuit generates another mirrored current that is provided to and for use as a reference current by a third group driver circuit.

18. A program storage device storing instructions that when executed by a processor perform a method of balancing currents in a display device having at least first and second display areas, each including left and right end regions, the method comprising:

generating a first current from a first driver circuit substantially in the right end region of the first display area;

generating a second current from a second driver circuit substantially in the left end region of the second display area;

comparing the first current to the second current; and substantially matching the first current with the second current.

19. The method as defined in claim 18, wherein the first and second driver circuits comprise column drivers of the display areas.

20. The method as defined in claim 18, wherein the first driver circuit comprises a right end column driver of the first display area, and the second driver circuit comprises a left end column driver of the second display area.

21. The method as defined in claim 18, wherein the display areas comprise a plurality of column drivers, each comprising at least a resistor and a transistor that are configured to drive a current to illuminate a plurality of pixels.

22. The method as defined in claim 18, wherein the first driver circuit comprises one, two, three, four, and five adjacent right end column drivers of the first display area, and the second driver circuit comprises one, two, three, four, and five adjacent left end column drivers of the second display area.

* * * * *